US006669189B2

(12) United States Patent
Seto et al.

(10) Patent No.: US 6,669,189 B2
(45) Date of Patent: Dec. 30, 2003

(54) IMAGE FORMING APPARATUS

(75) Inventors: Takashi Seto, Yokohama (JP); Yasushi Nakazato, Tokyo (JP); Seiji Hoshino, Atsugi (JP); Hiromichi Matsuda, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/054,993

(22) Filed: Jan. 25, 2002

(65) Prior Publication Data

US 2002/0113357 A1 Aug. 22, 2002

(30) Foreign Application Priority Data

| | | |
|---|---|---|
| Jan. 26, 2001 | (JP) | 2001-018687 |
| Mar. 15, 2001 | (JP) | 2001-073504 |
| Mar. 30, 2001 | (JP) | 2001-101284 |
| Apr. 23, 2001 | (JP) | 2001-124133 |
| Dec. 27, 2001 | (JP) | 2001-398022 |

(51) Int. Cl.[7] ..... B65H 29/00
(52) U.S. Cl. ..... 271/186; 399/364
(58) Field of Search ..... 399/364, 388, 399/390, 394, 395, 396, 401, 402; 271/186

(56) References Cited

U.S. PATENT DOCUMENTS

| | | | | |
|---|---|---|---|---|
| 6,345,170 B1 | | 2/2002 | Nakazato et al. | |
| 6,402,133 B1 | * | 6/2002 | Miyake | 271/3.19 |
| 6,470,169 B2 | * | 10/2002 | Nakazato | 399/388 |
| 6,505,014 B2 | | 1/2003 | Aoki et al. | |
| 2001/0031161 A1 | * | 10/2001 | Nakazato | 399/388 |

FOREIGN PATENT DOCUMENTS

| | | |
|---|---|---|
| JP | 6-236086 | 8/1994 |
| JP | 2941021 | 8/1999 |

* cited by examiner

*Primary Examiner*—Donald P. Walsh
*Assistant Examiner*—Kaitlin Joerger
(74) *Attorney, Agent, or Firm*—Oblon, Spivak, McClelland, Maier & Neustadt, P.C.

(57) ABSTRACT

An image forming apparatus of the present invention includes a conveyance path extending from a sheet tray to an image forming section. A switchback path with a reversing device is connected to the intermediate portion of the conveyance path for switching back a sheet thereon. The switchback path reduces an interval between consecutive sheets being conveyed in the apparatus for thereby enhancing the productivity of image formation. In addition, the switchback path switches back a sheet being conveyed via a refeed path and the above conveyance path in a duplex print mode, thereby obviating the need of an exclusive switchback path for the duplex print mode. The apparatus is reduced in thickness despite the presence of the switchback path.

56 Claims, 17 Drawing Sheets

IMAGE FORMING APPARATUS

BACKGROUND OF THE INVENTION

1. Field of the Invention

The present invention relates to an image forming apparatus and more particularly to an image forming apparatus of the type operable in a duplex print mode and capable of stacking prints face down in order of page.

2. Description of the Background Art

An electrophotographic copier, printer, facsimile apparatus or similar image forming apparatus of the type described usually includes a first path and a second path arranged at the sheet discharge side of an image forming section 102. The first path conveys a sheet carrying an image thereon toward a sheet outlet section while the second path conveys it in a duplex print mode or to reverse the sheet and then discharge it. A path selector is located at the position where the first and second paths part from each other. The path selector selectively steers a sheet coming out of the image forming section to the first path or the second path.

The second path merges into a switchback path that reverses the sheet by switching it back. A reverse roller is positioned on the switchback pack and movable into and out of contact with the sheet (up-and-down direction). In the duplex print mode, the refeed path again conveys the sheet switched back by the switchback path toward the image forming section. The reverse discharge path discharges the above sheet to a sheet outlet section face down in order of page. The refeed path is positioned below the switchback path. A path selector is located at a position where the refeed path and reverse discharge path part from each other. This path selector selectively steers the sheet switched back by the switchback path to the refeed path or the reverse discharge path.

To reverse the sheet carrying an image on one side thereof and then discharge it, the path selector again delivers the sheet to the second path. In this case, the path selector is so positioned as to steer the sheet driven out of the switchback path to the reverse discharge path. As a result, the sheet is driven out to the sheet outlet section face down via the reverse discharge path.

The conventional image forming apparatus described above has undesirably great height because of the switch back path and refeed path arranged one above the other.

Technologies relating to the present invention are disclosed in, e.g., Japanese Patent Laid-Open Publication No. 6-236086 and Japanese Patent No. 2,941,021.

SUMMARY OF THE INVENTION

It is an object of the present invention to provide an image forming apparatus capable of enhancing the productivity of image formation in a repeat print mode by reducing the interval between consecutive sheets at an image forming section, and obviating the need for an exclusive switchback path for a duplex print mode.

An image forming apparatus of the present invention includes a sheet tray loaded with a stack of sheets. A separating and feeding device feeds one sheet from the sheet tray while separating it from the other sheets. An image forming section forms an image on the sheet fed by the separating and feeding device. A conveyance path conveys the sheet from the sheet tray to the image forming section. A switchback path is connected to the intermediate portion of the conveyance path for receiving the sheet being conveyed along the conveyance path. A reversing device is selectively switchable to a first position for switching back the preceding sheet introduced into the switchback path to thereby feed it to the conveyance path or a second position for allowing the preceding sheet being fed from the switchback path and the following sheet to be introduced into the switchback path after the preceding sheet to at least partly overlap each other. A refeed path is connected to the sheet outlet side of the image forming section and part of the conveyance path upstream of the switchback path. A conveying device conveys the sheet driven into the refeed path to the conveyance path.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
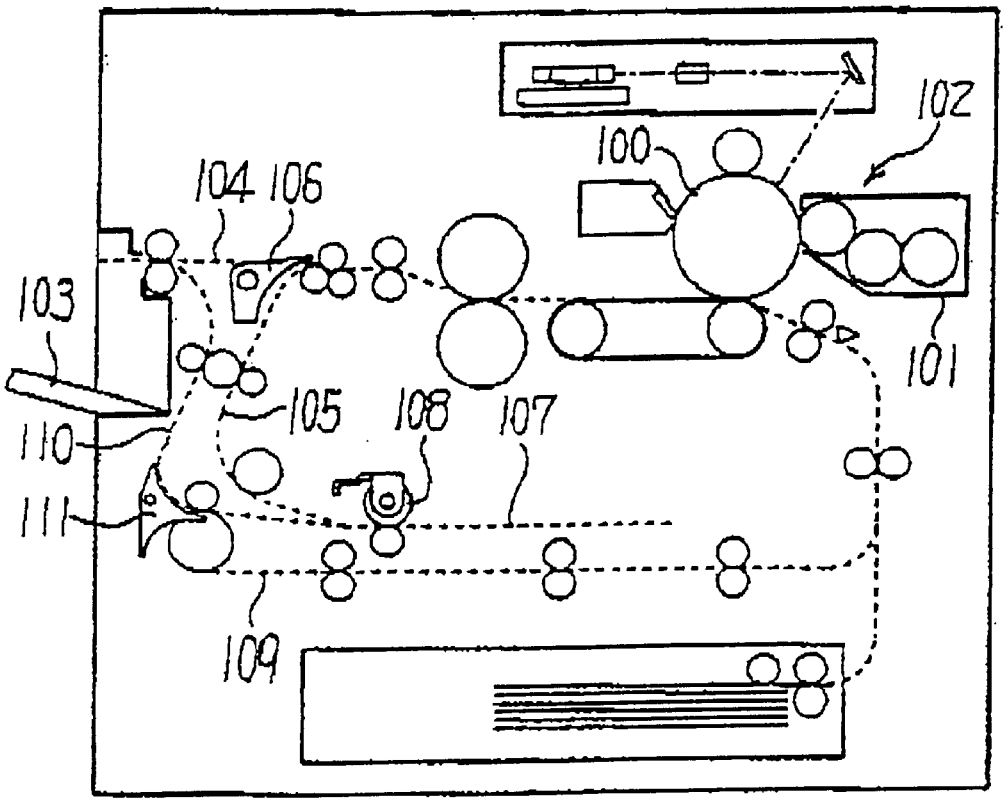
FIG. 1 PRIOR ART
FIG. 1 is a view showing a conventional image forming apparatus.

To better understand the present invention, brief reference will be made to a conventional image forming apparatus, shown in FIG. 1. The image forming apparatus to be described is of the type operable in a duplex print mode and capable of discharging prints face down in order of page. As shown, the image forming apparatus includes an image forming section 102 including a photoconductive drum 100 and a developing device 101. The image forming section 102 prints an image on a sheet.

A first path 104 and a second path 105 are arranged at the sheet discharge side of the image forming section 102. The first path 104 conveys the sheet carrying an image thereon toward a sheet outlet section 103 while the second path 105 conveys it in the duplex print mode or to reverse the sheet and then discharge it. A path selector 106 is located at the position where the first path 104 and second path 105 part from each other. The path selector 106 selectively steers the sheet coming out of the image forming section 102 to the first path 104 or the second path 105.

The second path 105 merges into a switchback path 107 that reverses the sheet by switching it back. A reverse roller 108 is positioned on the switchback pack 107 and movable into and out of contact with the sheet (up-and-down direction).

A refeed path 109 and a reverse discharge path 110 are arranged downstream of the switchback path 107 in the direction of sheet conveyance. In the duplex print mode, the refeed path 109 again conveys the sheet switched back by the switchback path 107 toward the image forming section 102. The reverse discharge path 110 reverses the above sheet and then discharges it to the sheet outlet section 103 face down in order of page. The refeed path 109 is positioned below the switchback path 107. A path selector 111 is located at a position where the refeed path 109 and reverse discharge path 110 part from each other. The path selector 111 selectively steers the sheet switched back by the switchback path 107 to the refeed path 109 or the reverse discharge path 110.

In a duplex print mode, the path selector 106 is so positioned as to steer a sheet carrying an image one side thereof toward the second path 105. In this condition, the sheet is conveyed to the switchback path 107 via the second path 105. The roller 108 switches back the sheet out of the switchback path 107. At this instant, the path selector 111 is so positioned as to steer the sheet coming cut of the switchback path 107 to the refeed path 109, so that the sheet is again conveyed to the image forming section 102. After an image has been formed on the other side of the sheet, the sheet is driven out to the sheet outlet section 103 via the first path 104.

To reverse the sheet carrying an image on one side thereof and then discharge it, the path selector 106 again delivers the sheet to the second path 105. In this case, the path selector 111 is so positioned as to steer the sheet driven out of the switchback path 107 by the roller 108 to the reverse discharge path 110. As a result, the sheet is driven out to the sheet outlet section 103 face down via the reverse discharge path 110.

The conventional image forming apparatus described above has great height because of the switch back path 107 and refeed path 109 arranged one above the other, as stated earlier.

Figure 2:
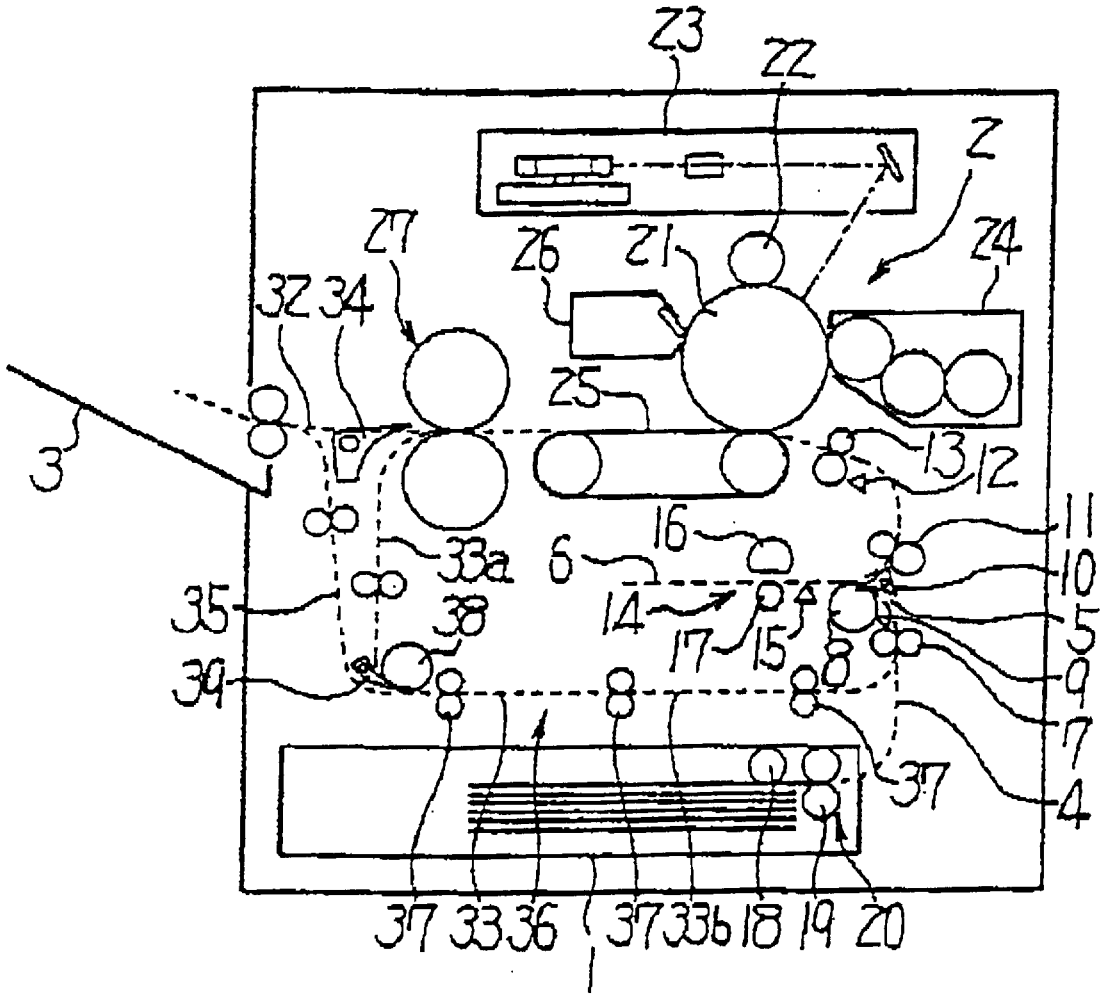
FIG. 2 is a view showing an image forming apparatus embodying the present invention.

Referring to FIGS. 2 through 12, an image forming apparatus embodying the present invention will be described. As shown in FIG. 2, the image forming apparatus includes a sheet tray 1 loaded with a stack of sheets. An image forming section 2 forms an image on one side of a sheet fed from the sheet tray 1 or the other side of a sheet carrying an image on one side thereof and again fed thereto. A sheet outlet section 3 drives the sheet coming out of the image forming section 2 out of the apparatus. A plurality of paths are arranged inside of the apparatus for conveying a sheet between the sheet tray 1, the image forming section 2, and the sheet outlet section 3.

Specifically, a conveyance path 4 extends from the sheet tray 1 to the image forming section 2 and branches into a switchback path 6 at a point 5. The switchback path 6 switches back the sheet being conveyed along the conveyance path 4. More specifically, the sheet conveyed along the conveyance path 4 is steered into the switchback path 6 via the point 5 and then again returned to the path 4 by reversing means, which will be described later specifically.

A roller pair 7 is positioned upstream of the point 5 of the path 4 in the direction of sheet conveyance and rotated by a motor not shown. An inlet roller 8, an inlet sensor 9 and a path selector 10 are located around the point 5. A motor, not shown, causes the inlet roller 8 to rotate for introducing the sheet into the switchback path 6. The inlet sensor 9 is positioned upstream of the inlet roller 8 in the direction of sheet conveyance for sensing the leading edge of the sheet. The path selector 10 steers the sheet from the conveyance path 4 to the switchback path 6 or steers it from the path 6 to the path 4. In the illustrative embodiment, the sheet sensor 9 is implemented as a reflection type optical sensor made up of a light emitting device and a light-sensitive device, although not shown specifically.

An intermediate roller pair 11 is positioned downstream of the point 5 in the direction of sheet conveyance. A motor, not shown, drives the roller pair 11 for conveying the sheet coming out of the switchback path 6 toward the image forming section 2. A registration sensor 12 and a registration roller pair 13 are positioned downstream of the roller pair 11. The registration roller pair 13 starts conveying the sheet sensed by the registration sensor 12 to the image forming section 2 in synchronism with the operation of the section 12. The registration sensor 12 is also a reflection type optical sensor.

A reversing device, or the previously mentioned reversing means, 14 and a reversal sensor 15 are positioned on the switchback path 6. The reversing device 14 selectively takes a closed or feed position or an open position. In the closed position, the reversing device 4 again feeds the sheet from the switchback path 6 to the conveyance path 4. In the open position, the reversing device 14 allows the sheet being again fed to the conveyance path 4 and the subsequent sheet being introduced into the switchback path 6 to at least partly overlap each other. The reversal sensor 15 is responsive to the leading edge of the sheet being introduced into the switchback path 6 and is also implemented by a reflection type optical sensor.

Figure 5A:
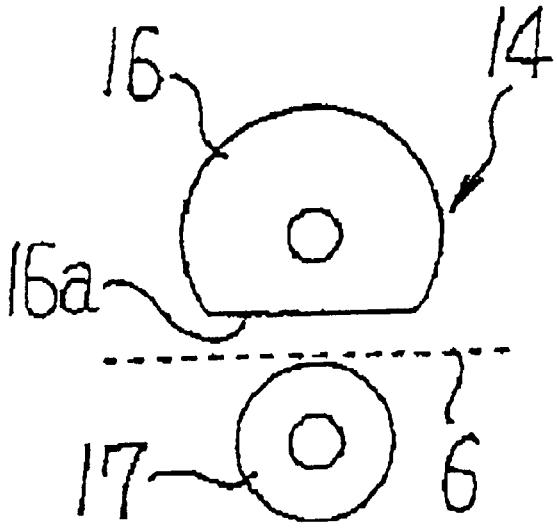
FIG. 5A shows reversing means included in the illustrative embodiment in an open position.
Figure 5B:
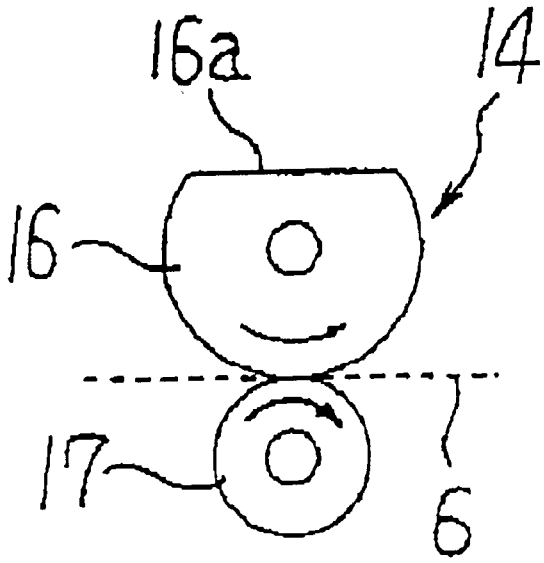
FIG. 5B shows the reversing means in a closed position.

FIGS. 5A and 5B show the reversing device 14 specifically. As shown, the reversing device 14 is made up of a reverse roller 16 and a driven roller 17. A stepping motor, not shown, causes the reverse roller 16 to intermittently rotate. The driven roller 17 contacts the reverse roller 16 with the intermediary of the switchback path 6 and is driven by the reverse roller 16. Part of the circumference of the reverse roller 16 is removed, forming a flat face 16*a*. As shown in FIG. 5A, when the flat face 16*a* faces the driven roller 17, the former and latter form a gap therebetween.

As shown in FIG. 5, the reverse roller 16 is rotated in a direction indicated by an arrow in contact with the driven roller 17, causing the driven roller 17 to rotate. In this condition, the reverse roller 16 and driven roller 17 convey a sheet toward the conveyance path 4. In the condition shown in FIG. 5, a sheet is introduced into the switchback path 6 via the gap between the reverse roller 16 and the driven roller 17. It should be noted that a sheet moves at a higher speed when fed from the conveyance path 4 to the switchback path 6 than when fed from the latter to the former.

Referring again to FIG. 2, a pickup roller 18 pays out the sheets from the sheet tray one by one while a reverse roller 19 separates one sheet being paid out from the other sheets. The pickup roller 18 and reverse roller 19 constitute a separating and feeding device 20.

The image forming section 2 includes a photoconductive drum 21. A charger 22 uniformly charges the surface of the drum 21. A digital, optical writing unit or means 23 optically writes a latent image on the charged surface of the drum 21. A developing unit 24 develops the latent image with toner to thereby form a corresponding toner image. An image transferring device transfers the toner image from the drum 21 to the sheet. A drum cleaner 26 removes toner left on the drum 21 after the image transfer. A fixing device 27 fixes the toner image on the sheet. The image forming section 2 executes a digital, electrophotographic image forming process.

Figure 3:
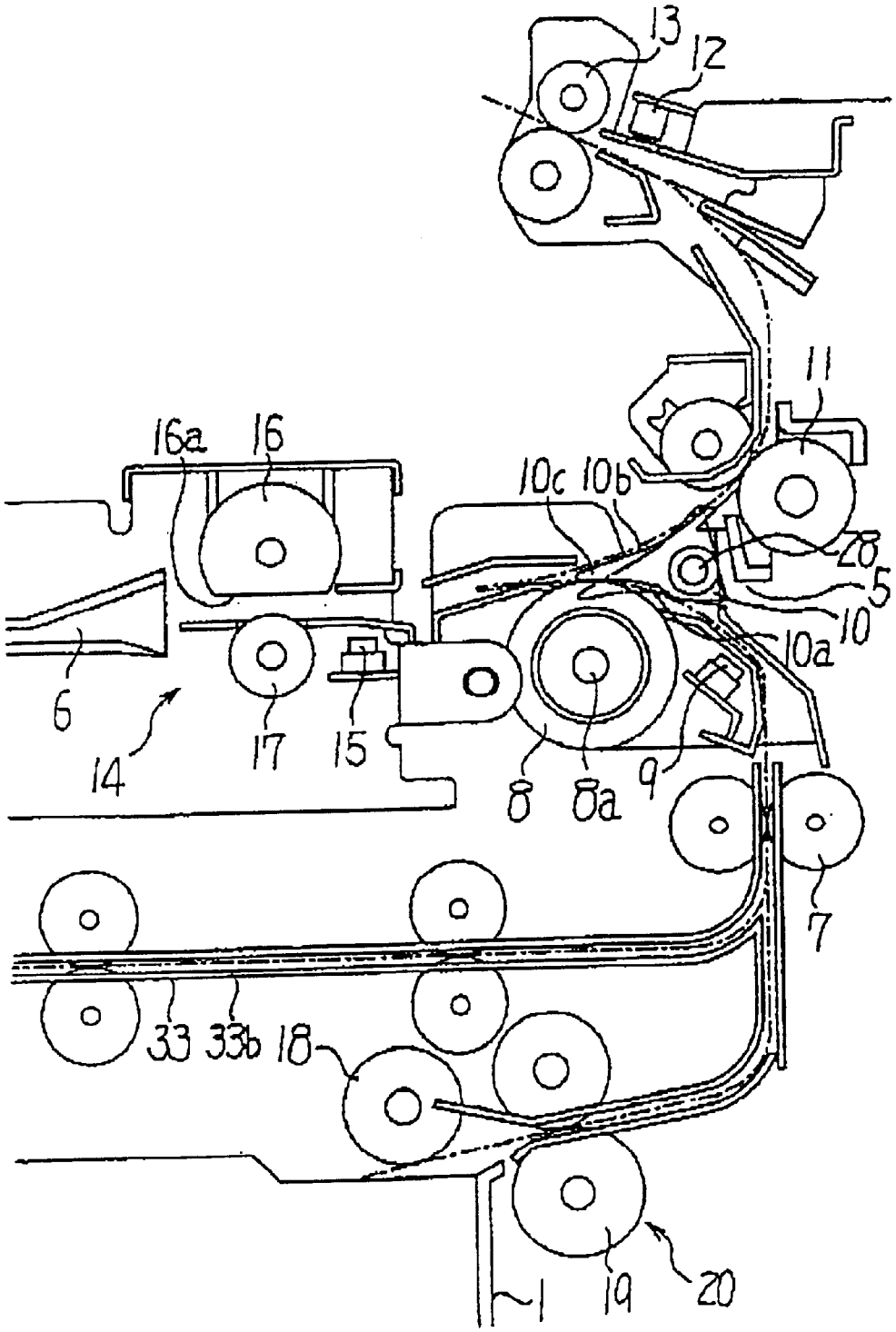
FIG. 3 is an enlarged front view of a mechanism arranged along a conveyance path in the illustrative embodiment.

As shown in FIG. 3, the path selector 10 located at the point 5 has a generally triangular contour including a first guide surface 10*a*, a second guide surface 10*b*, and a tip 10*c* with an acute angle between the first and second guide surfaces 10*b*. The first guide surface 10*a* guides the sheet being fed into the switchback path 6 while the second guide surface 10*b* guides the sheet being fed out of the switchback path 6. The tip 10*c* races the switchback path 6.

Figure 4:
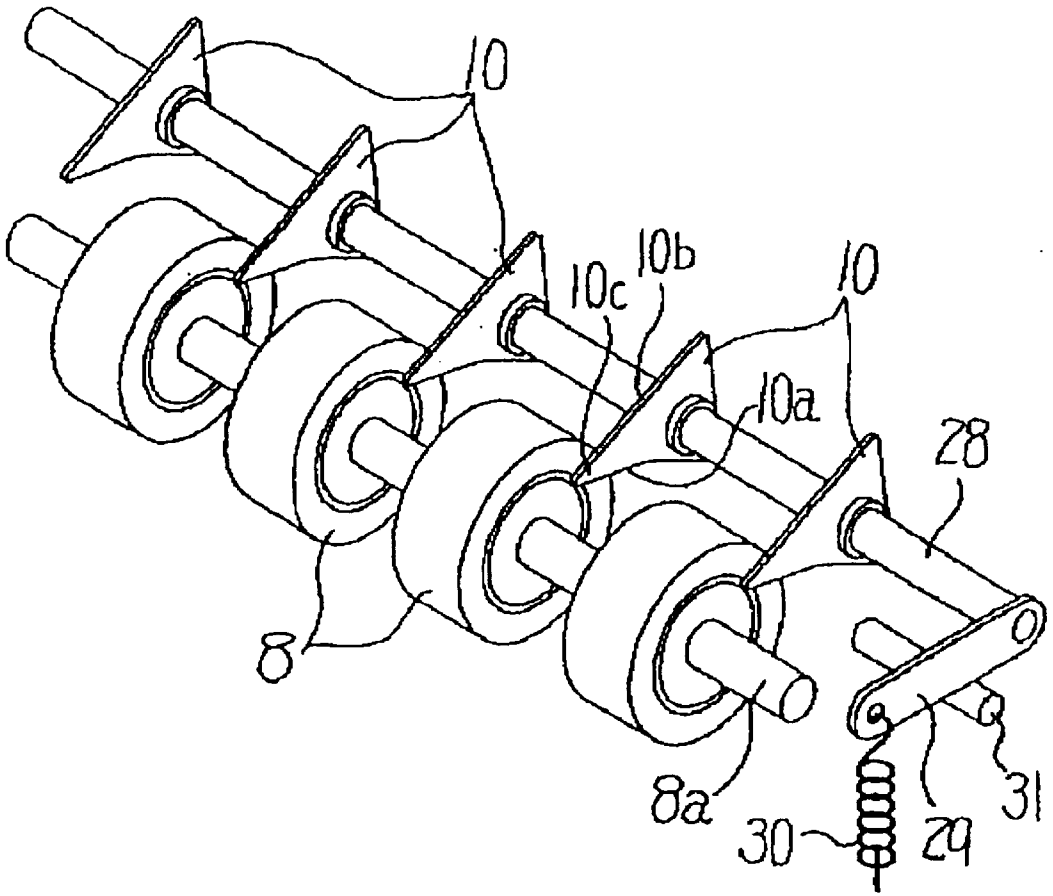
FIG. 4 is an isometric view of an inlet roller and a path selector.

As shown in FIG. 4, a plurality of path selectors 10 each having the contour shown in FIG. 3 are mounted on a shaft 28, which adjoins and extends in parallel to a shaft 8*a* supporting the inlet roller 8. The inlet roller 8 is also implemented as a plurality of rollers 8, as illustrated. The shaft 28 is rotatably supported by bearings not shown. An arm 29 is connected at one end to one end of the shaft 28. A spring 30 is anchored at one end to the other end of the arm 29. A stop 31 restricts the rotation of the arm 29 being constantly biased downward by the spring 30.

The shaft 28 is rotatable to selectively move the path selectors 10 to a first position indicated by a solid line in FIG. 3 or a second position indicated by a phantom line in FIG. 3. In the first position, the sheet introduced into the switchback path 6 angularly moves the path selectors 10 due to its own elasticity against the bias of the spring 30 and passes through the gap between the inlet rollers 8 and the first guide surfaces 10*a* of the path selectors 10. In the second position, no sheets are present between the inlet rollers 8 and the first guides 10*a* of the path selectors 10; the arm 29 abuts against the stop 31 due to the bias of the spring 30 with the tips 10*c* of the path selectors 10 being positioned radially inward of the circumferences of the inlet rollers 8. Let the inlet rollers 8 and path selectors 10 be respectively represented by a single inlet roller 8 and a single selector 10 for simplicity hereinafter.

As shown in FIG. 2, a direct discharge path 32 extends between the sheet discharging side of the image forming section 2 and the sheet outlet section 3. A refeed path 33 extends between the sheet discharging side of the image forming section 2 and part of the conveyance path 4 upstream of the point 5 in the direction of sheet conveyance. A path selector 34 is located at a point where the direct discharge path 32 and refeed path 33 part from each other at the sheet discharging side of the image forming section 2. The path selector 34 selects either one of the direct discharge path 32 and refeed path 33.

The refeed path includes a vertical portion 33*a* extending downward and a horizontal portion 33*b* extending from the lower end of the vertical portion 33*a* in substantially the horizontal direction The end of the horizontal portion 33*b* remote from the vertical portion 33*a* merges into the conveyance path 4.

A reverse discharge path 35 branches from the refeed path 33 at the bent portion between the vertical portion 33*a* and the horizontal portion 33*b*. The reverse discharge path 35 is connected to the sheet outlet section 3.

A refeed roller 36 is positioned on the horizontal portion 33*b* of the refeed path 33. The refeed roller 36 plays the role of conveying means and reverse discharging means at the same time. Specifically, the refeed roller 36 is selectively rotatable in the forward direction for feeding the sheet out of the refeed path 33 to the conveyance path 4 in the duplex print mode (duplex-print feed state) or rotatable in the reverse direction for switching back the sheet toward the reverse discharge path 35 (reverse discharge state). More specifically, the refeed roller 36 is implemented by a plurality of roller pairs 37 each having a reversible drive roller and a driven roller movable into and out of contact with the drive roller, as illustrated. The drive rollers of the roller pairs 37 each can be driven independently of the others. The refeed roller 36 is capable of nipping the sheet on the horizontal path 33*b* to thereby interrupt conveyance and again driving it toward the conveyance path 4 at a suitable timing in response to, e.g., the output of a sheet sensor not shown.

Figure 6:
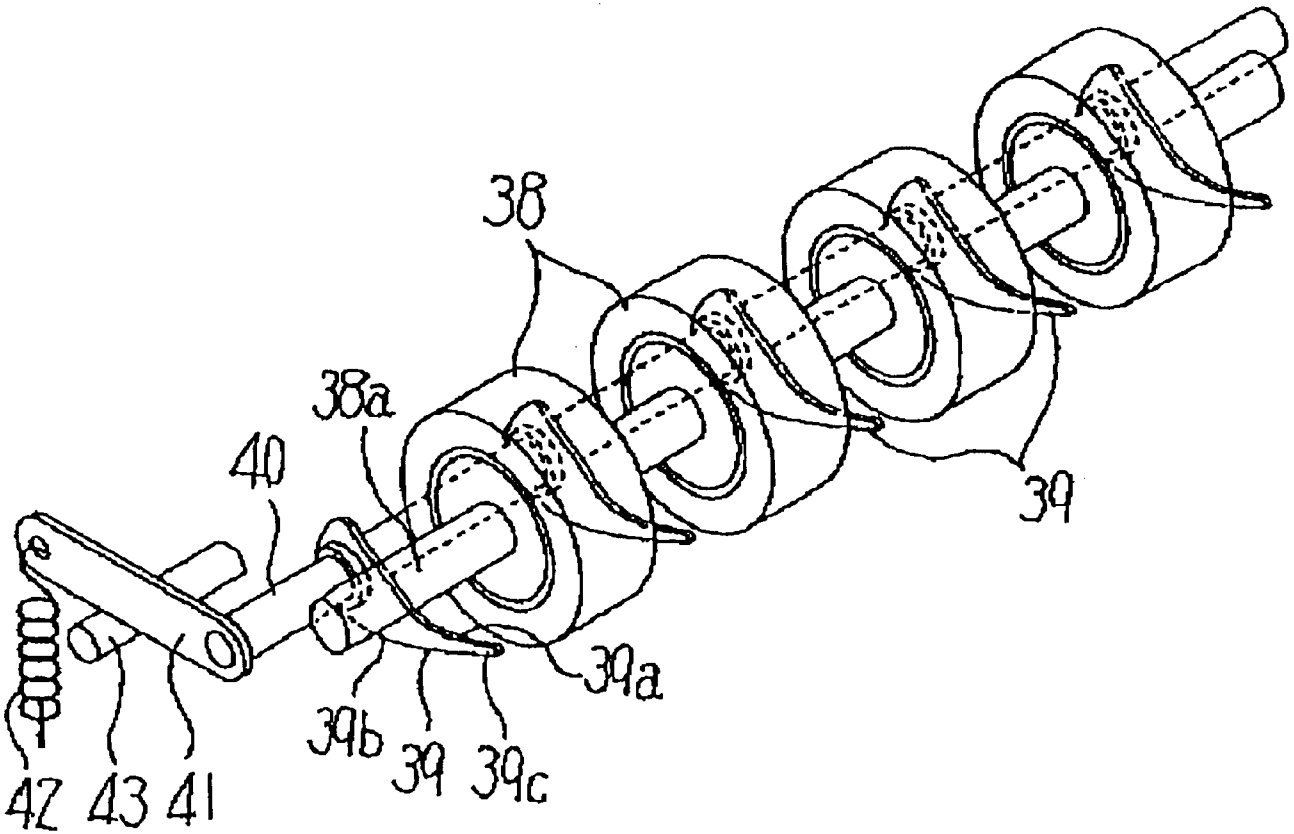
FIG. 6 is an isometric view showing a roller and another path selector also included in the illustrative embodiment.

A roller 38 and a path selector 39 are located at a position where the refeed path 33 merges into the reverse discharge path 33. The roller 38 is rotated to convey the sheet from the vertical portion 33*a* to the horizontal portion 33*b* of the refeed path 33. As shown in FIG. 6, the path selector 39 is also implemented as a plurality of path selectors 39 mounted on a shaft 40, which adjoins and extends in parallel to a shaft 38*a* supporting the roller 38. The roller 38 is also implemented as a plurality of rollers 38. Each path selector 39 has a generally triangular contour including a first guide surface 39*a* for guiding the sheet being conveyed from the vertical portion 33*a* to the horizontal portion 33*b*, a second guide surface 39*b* for guiding the sheet being switched back toward the reverse discharge path 35, and a tip 39*c* with an acute angle between the two guide surfaces 39*a* and 39*b*. An arm 41 is connected at one end to one end of the shaft 40. A spring 42 is anchored at one end to the other end of the arm 41. A stop 43 restricts the movement of the arm 41 being constantly biased downward by the spring 42.

The shaft 40 is rotatable to selectively move the path selectors 39 to a first position or a second position. In the first position, the sheet advancing from the vertical portion 33*a* to the horizontal portion 33*b* angularly moves the path selectors 39 due to its own elasticity against the bias of the spring 42 and passes through the gap between the rollers 38 and the first guide surfaces 39*a* of the path selectors 39. In the second position, no sheets are present between the rollers 38 and the first guides surface 39*a* of the path selectors 39, as shown in FIGS. 2 and 6; the arm 41 abuts against the stop 43 due to the bias of the spring 42 with the tips 39*c* being positioned radially inward of the circumferences of the rollers 38. In the second position, the tips 39 prevent the sheet switched back from entering the vertical path 33*a* while guiding it toward the reverse discharge path 35. Again, let the rollers 38 and path selectors 39 be respectively represented by a single inlet roller 38 and a single selector 39 for simplicity hereinafter.

The sheet being switched back from the horizontal portion 33*b* to the reverse discharge path 35 and the sheet being transferred from the vertical portion 33*a* to the horizontal portion 33*b* can pass each other. More specifically, the horizontal portion 33*b* has a height great enough to allow two sheets to pass each other. In addition, assume that the refeed roller 36, i.e., roller pairs 37 are held in the reverse discharge state for feeding the preceding sheet into the reverse discharge path 35. Then, as soon as the following sheet enters the horizontal portion 33*b*, the driven rollers of the roller pairs 37 are released from the drive rollers to allow the sheet into the horizontal portion 33*b*.

The sheet is conveyed along the refeed path 33 at a speed higher than the image forming process speed of the image forming section 2. For example, while the process speed of the image forming section 2 is 330 mm/sec, the sheet is conveyed along the refeed path 33 at a speed of 560 mm/sec. This is also true with the conveyance of the sheet along the reverse discharge path 35.

In the configuration described above, the separating and feeding device 20 feeds one sheet from the sheet tray 1 to the conveyance path 4 while separating it from the other sheets. As soon as the inlet sensor 9 located at the point 5 senses the leading edge of the sheet, the inlet roller 8 is caused to start rotating. Further, when the leading edge of the sheet abuts against the first guide surface 10*a* of the path selector 10, which is held in the second position, the sheet raises the path selector 10 to the first position due to its own elasticity. The sheet then advances to the switchback path 6 via the gap between the first guide surface 10*a* and the inlet roller 8. At this instant, the reversing device 14 is held in the open position shown in FIG. 5A.

As the trailing edge of the sheet moves away from the gap between the first guide surface 10*a* and the inlet roller 8, the path selector 10 automatically returns to the second position due to the bias of the spring 30. In the second position, the tip 10*c* of the path selector 10 surely prevents, when the sheet is driven out of the switchback path 6, the leading edge of the sheet from entering between the inlet roller 8 and the first guide surface 10*a*. This guarantees smooth feed of the sheet from the switchback path 6 toward the image forming section 2.

To feed the sheet out of the switchback path 6, the reverse roller 16 of the reversing device 14 is rotated counterclockwise, as viewed in FIG. 5B, causing the driven roller 17 to rotate. The reverse roller 16 and driven roller 17 therefore convey the sheet out of the switchback path 6 by nipping it. The intermediate roller pair 11 nips and conveys the leading edge of the sheet coming out of the switchback path 6. At this time, the reversing device 14 is brought to the condition shown in FIG. 5A, releasing the sheet. In the position shown in FIG. 5A, the reversing device 14 allows the following sheet into the switchback path 6.

The intermediate roller pair 11 conveys the sheet until the leading edge of the sheet abuts against the registration roller pair 13. The registration roller pair 13 starts rotating at a preselected timing to convey the sheet to the image forming section 2.

Figure 7:
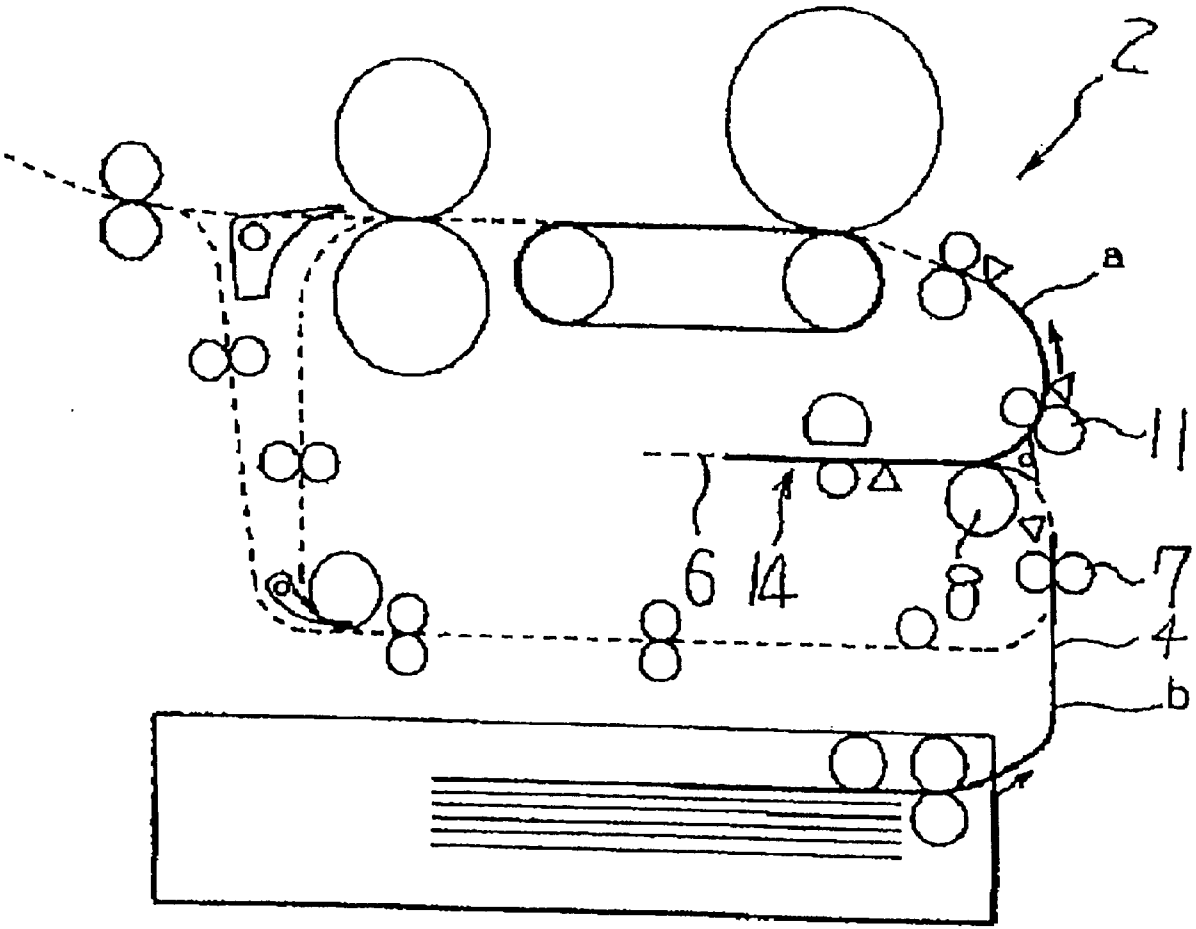
FIGS. 7 and 8 are views showing how consecutive sheets are sequentially fed to an image forming section included in the illustrative embodiment.
Figure 8:
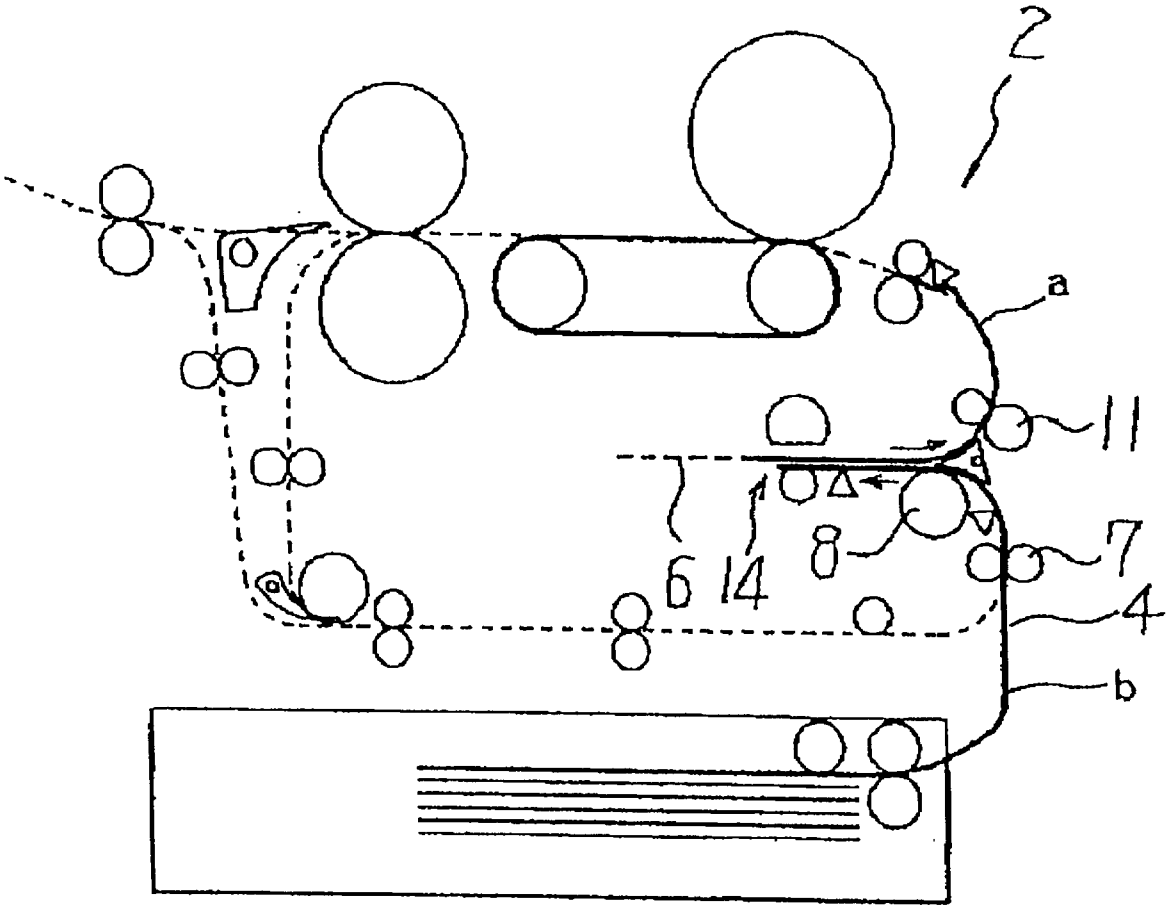

Reference will be made to FIGS. 7 and 8 for describing the flow of consecutive sheets to occur in a repeat print mode As shown, as soon as the preceding sheet a is driven out of the switchback path 6 toward the conveyance path 4, the following sheet b is conveyed toward the switchback path 6. More specifically, the reversing device 15 first conveys the sheet a and then releases it, as shown in FIG. 5A. Subsequently, the intermediate roller pair 11 conveys the sheet a toward the image forming section 2. On the other hand, the roller pair 7 and inlet roller 8 sequentially convey the following sheet b, so that the sheet b enters the switchback path 6 via the reversing device 14 held in the position shown in FIG. 5A. At this instant, the trailing edge portion of the preceding sheet a and that of the following sheet b (leading edge when switched back) momentarily overlap each other.

After the preceding sheet a has been fully fed out of the switchback path 6, the following sheet b is fed out of the switchback path 6 at the time when the trailing edge of the sheet a and the leading edge of the sheet are spaced by an adequate short distance. This successfully enhances the productivity of image formation.

Figure 12:
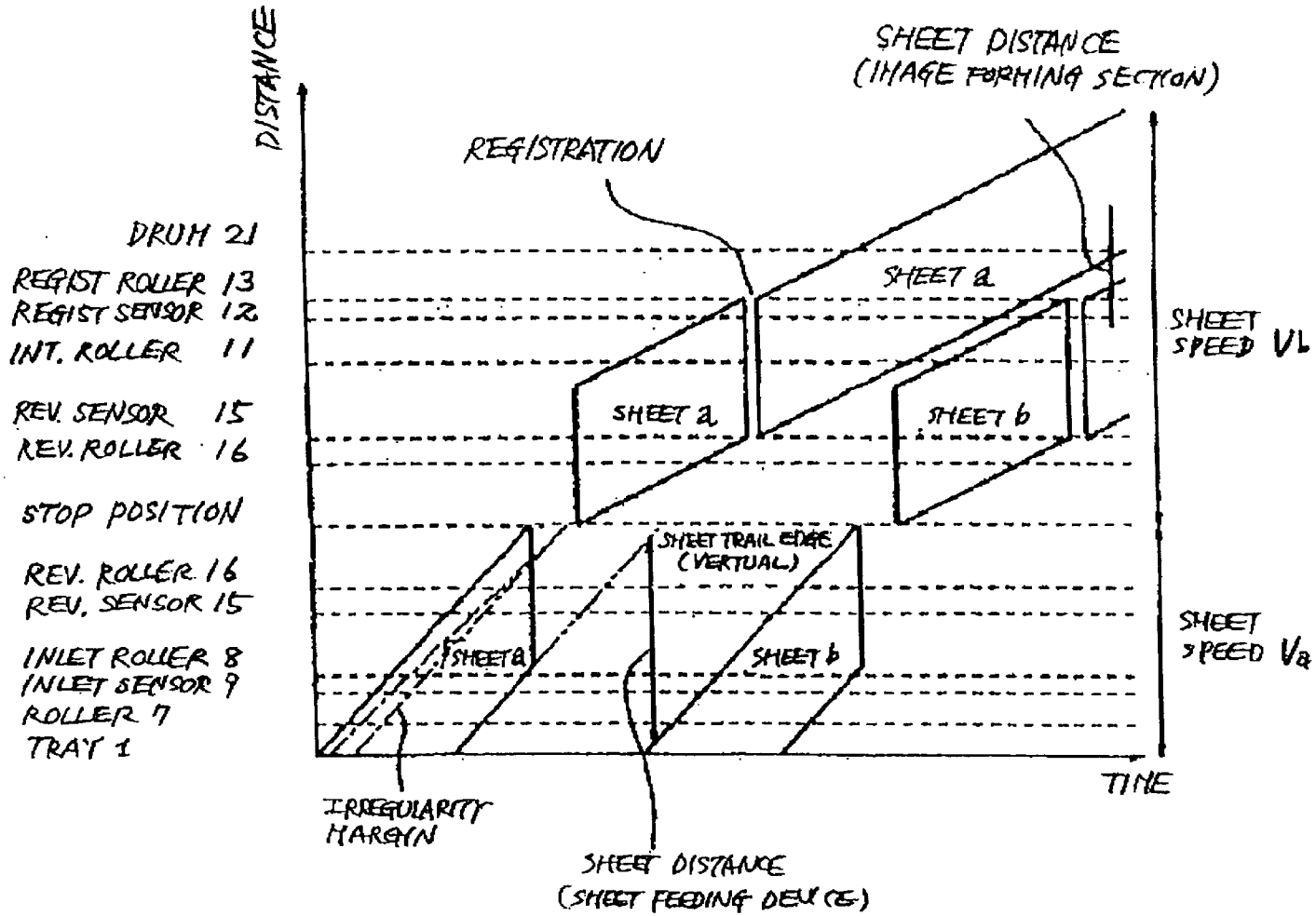
FIG. 12 is a diagram showing the feed of sheets in a repeat print mode.

FIG. 12 is a diagram demonstrating the conveyance of the consecutive sheets a and b. As shown, the roller pair 7 and inlet roller 8 convey each of the sheets a and b from the sheet tray 1 to the stop position on the switchback path 6 at a speed of Va. Subsequently, the reverse roller 16 and intermediate roller pair 11 convey the sheet from the above stop position to the image forming section 2 at a speed of Vb equal to the image forming speed. The speed Va is selected to be higher than the speed Vb.

Figure 9:
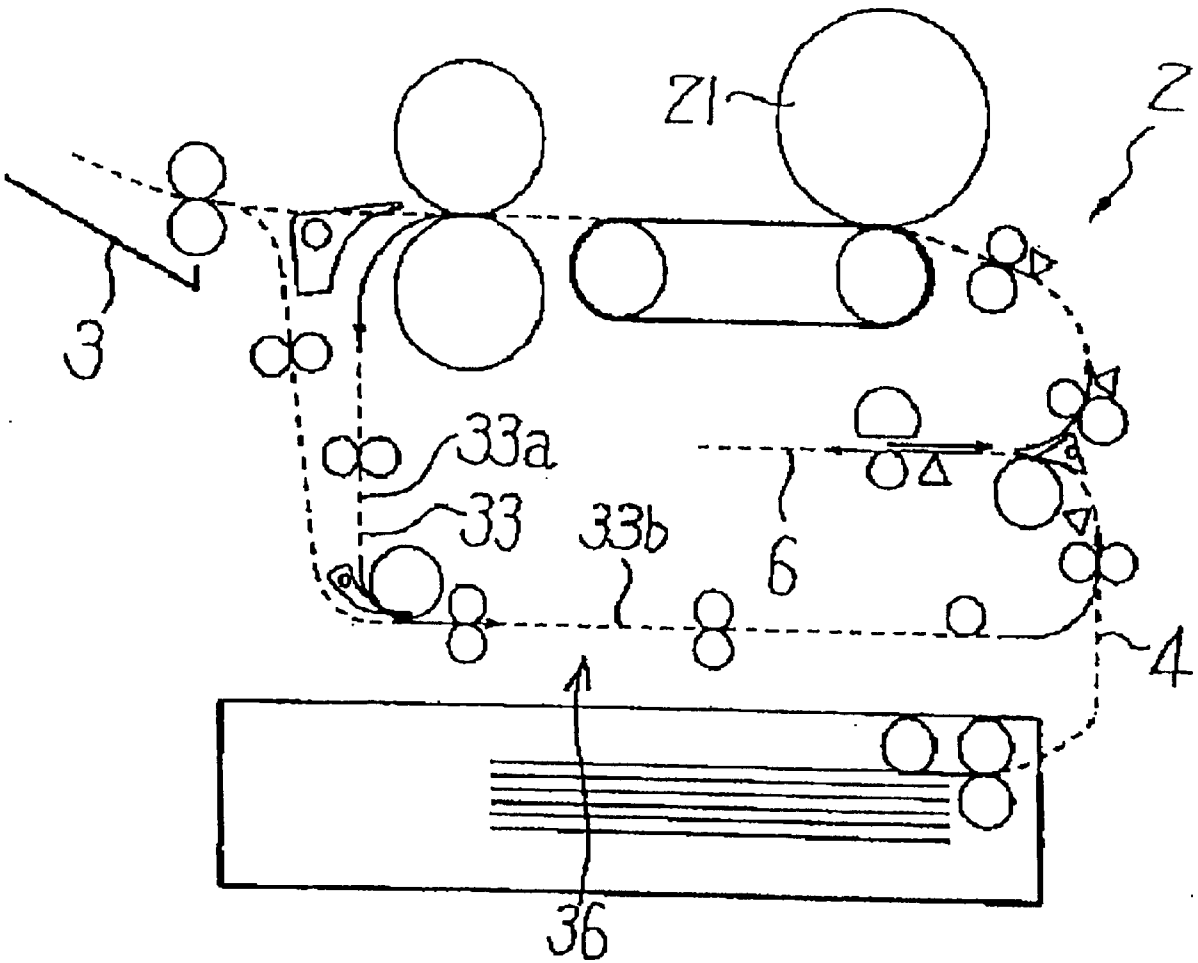
FIG. 9 is a view showing how a sheet is fed in a duplex print mode.

The flow of a sheet to occur in the duplex print mode will be described with reference to FIG. 9. As shown, a sheet carrying an image on one side thereof (one-sided sheet hereinafter) is conveyed from the image forming section 2 to the refeed path 33. The refeed roller 36 conveys the one-sided sheet straight to the path 4. Subsequently, the one-sided sheet, like a sheet fed from the sheet tray 1, is conveyed to the switchback path 6 and then switched back toward the image forming section 2 via the conveyance path 4. The one-sided sheet has therefore been reversed when reaching the image forming section 2. The image forming section 2 forms an image on the other side or reverse side of the one-sided sheet, producing a two-sided or duplex print.

As stated above, the illustrative embodiment switches back a sheet in the duplex print mode by using the switchback path 6 that is originally directed toward high productivity, thereby obviating the need for an exclusive path for the duplex print mode. The image forming apparatus is therefore reduced in height despite the presence of the switchback path 6.

The illustrative embodiment executes so-called interleaf sheet feed, i.e., interleaves a new sheet and a one-sided sheet in the duplex print mode. More specifically, in the duplex print mode, a plurality of (e.g. two or three) new sheets are continuously fed from the sheet tray 1 to the image forming section 2. The image forming section 2 prints images on one side of the consecutive sheets in preselected order of page (e.g. the first and third pages in the case of two sheets or the first, third and fifth pages in the case of three sheets). After the resulting first one-side sheet has been positioned in the horizontal portion 33*b* of the refeed path 33, the refeed roller 36 refeeds the one-sided sheet to the conveyance path 4 at a preselected timing. Thereafter, the one-sided sheets and new sheets paid out from the sheet tray 1 are alternately fed to the path 4. Two-sided sheets, or duplex prints, are sequentially driven out to the sheet outlet section 3 via the direct discharge path 32.

The sheet is conveyed along the refeed path 33 at a speed higher than the process speed of the image forming section 2, as stated earlier. Therefore, in the interleaf, duplex print mode, the sheet being conveyed along the refeed path 33 can be rapidly brought to the junction of the paths 33 and 4. This successfully reduces the interval between the sheet fed from the sheet tray 1 and the one-sided sheet fed from the refeed path 33 to the path 4 and thereby enhances the productivity of image formation.

Figure 10:
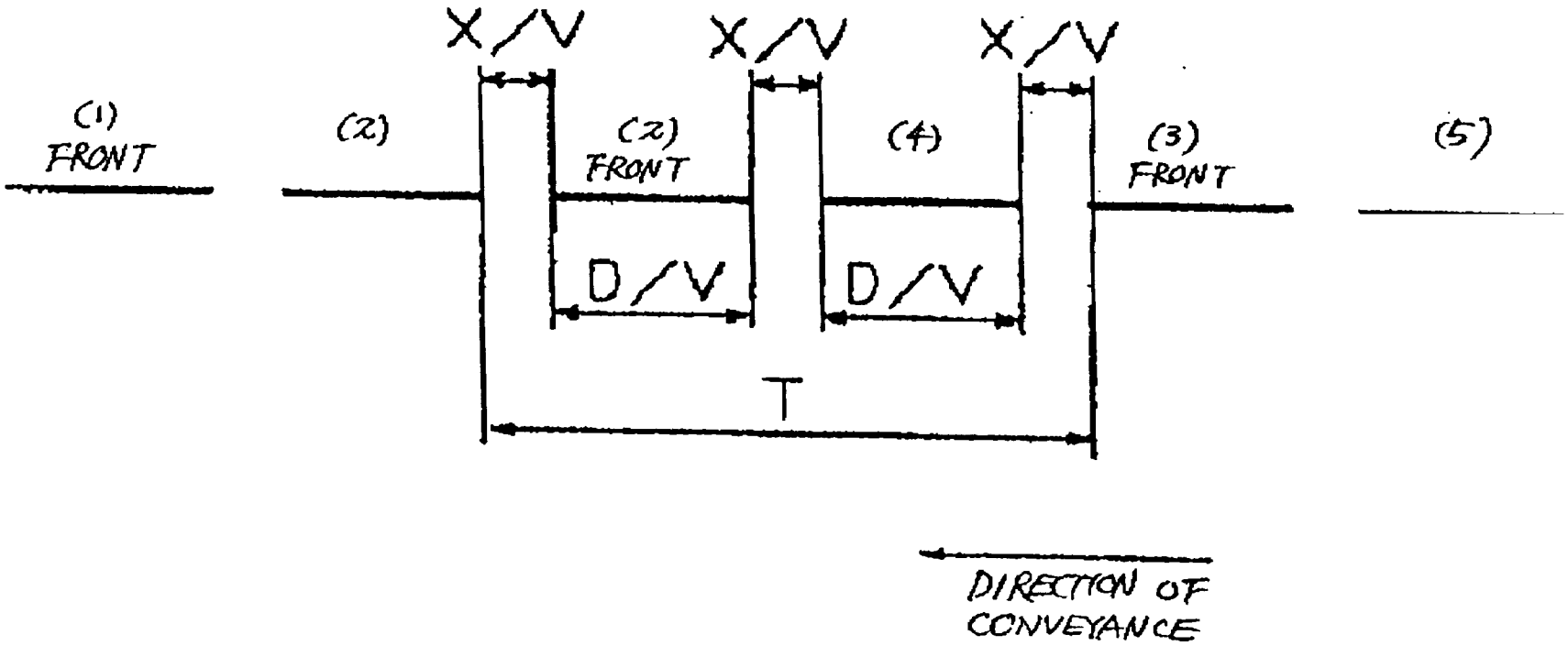
FIG. 10 shows the order of sheet feed and the interval between sheets, as seen at the junction of the conveyance path and a refeed path in a two-sheet interleaf, duplex print mode.

FIG. 10 shows the order of sheets being conveyed and the interval between the sheets, as seen at the junction of the paths 4 and 33, on the assumption that two sheets are continuously fed from the sheet tray 1 in the interleave, duplex print mode. Numbers attached to the sheets indicate the order of feed from the sheet tray 1 while the word "front" attached to the numbers refers to a one-sided sheet. Further, T indicates a time interval between the time when the trailing edge of a sheet fed from the sheet tray 1 (e.g. sheet (3)) moves away from the junction of the paths 4 and 33 and the time when the leading edge of the sheet (3) "front" to again reach the above junction via the image forming section 2 and path 33.

In the two-sheet interleaf moved, the time interval T is expressed as:

$$T=(2D+3X)/V \qquad \text{Eq. (1)}$$

where D denotes the length of the sheet, X denotes the distance between sheets measured at the junction of the paths 4 and 33, and V denotes a sheet speed also measured at the junction. It is to be noted that in the two-sheet interleaf mode, two sheets pass through the junction of the paths 4 and 33 during the period of time T.

Generally, in an n-sheet interleaf mode, the period of time T is expressed as:

$$T=[2(n-1)D+(2n-1)X]/V \qquad \text{Eq. (2)}$$

In this connection, in a three-sheet interleaf mode, four sheets pass through the junction of the paths 4 and 33 during the period of time T.

When the period of time T increases, the distance X between sheets, of course, increases and lowers productivity. The illustrative embodiment enhances productivity by reducing the interval between sheets in the interleaf, duplex print mode, as will be described hereinafter. First, the sheet speed V included in the Eq. (1) or (2) may be increased to reduce the interval between sheets. This can be done if a sheet is conveyed along the refeed path 33 at a speed higher than the process speed of the image forming section 2. Specifically, a control unit, not shown, included in the image forming apparatus stores a data table listing distances X and time intervals T in relation to sheet sizes and the number of sheets to be fed first. The control unit finds an adequate distance X and an adequate time interval T out of the data table and substitutes them for the Eq. (1) or (2) to thereby determine an adequate sheet speed V.

Second, a period of time necessary for a sheet to move from the switchback path 6 to the registration roller pair 13 may be reduced. More specifically, the duration of a stop of a sheet on the switchback path 6 maybe reduced to increase the sheet conveying speed from the path 6 to the registration roller pair 13.

As for the sheet speed V or the duration of a stop, assume that a period of time necessary for a sheet to move from the image forming section 2 to the junction of the paths 4 and 33 is fixed. Then, the control unit subtracts the fixed period of time from the time interval T and then calculates a duration of a stop or a sheet speed V that allows a sheet to move from the switchback path 6 to the registration roller 13 within the remaining period of time.

Figure 11:
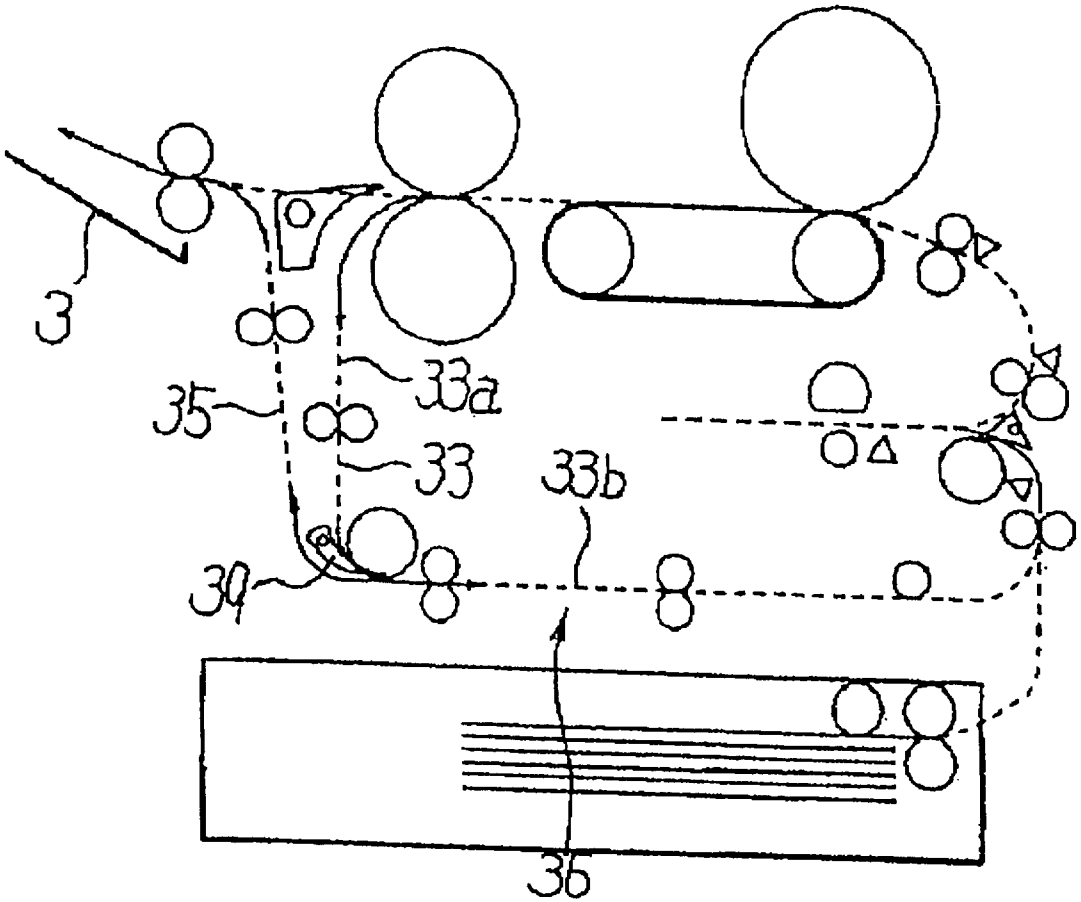
FIG. 11 is a view how a sheet is fed in a reverse discharge mode.

FIG. 11 shows how a one-sided sheet is driven out to the sheet outlet section 3 after being reversed. As shown, a one-sided sheet is conveyed along the refeed path 33 to the horizontal portion 33*b*. Subsequently, the refeed roller 36 switches back the sheet to the sheet outlet section 3 via the reverse discharge path 35. As a result, such sheets are sequentially stacked on the sheet outlet section 3 face down in order of page.

When the above one-sided sheet is about to reach the horizontal portion 33*b*, the path selector 39 is held at the second position. The sheet therefore moves the path selector 39 to the first position due to its own elasticity and then enters the horizontal portion 33*b*. As soon as 6 the trailing edge of the sheet moves away from the path selector 39, the path selector 39 automatically restores the second position due to the bias of the spring 42. Therefore, when the sheet is switched back toward the reverse discharge path 35, the path selector 39 surely guides the sheet to the reverse discharge path 35 by preventing it from entering the vertical portion 33*a* and jamming the portion 33*a*. Further, the spring 42 is simpler than a solenoid or similar electronic actuator. In addition, the movement of the path selector 39 effected by the spring 42 is sure and adaptive to high-speed sheet feed.

The sheet switched back to the reverse discharge path 35 and a sheet advancing toward the horizontal portion 33*b* via the vertical portion 33*a* can pass each other, as stated earlier. Therefore, just after the leading edge of the preceding sheet moved away from the path selector 39 into the reverse discharge path 35 has been nipped by a roller pair located on the path 35, the refeed roller 36 can be switched to its open position so as to allow the following sheet into the horizontal portion 36. It follows that smooth reverse discharge is achievable despite the short distance between one-sided sheets.

Further, the one-sided sheet is conveyed along the reverse discharge path 35 at a speed higher than the process speed of the image forming section 2, as also stated earlier. It is therefore possible to increase the distance between consecutive sheets sequentially conveyed along the reverse discharge path 35 to the sheet outlet section 3. This facilitates punching, stapling or similar finishing that may be executed with the sheets stacked on the sheet outlet section 3.

Figure 13:
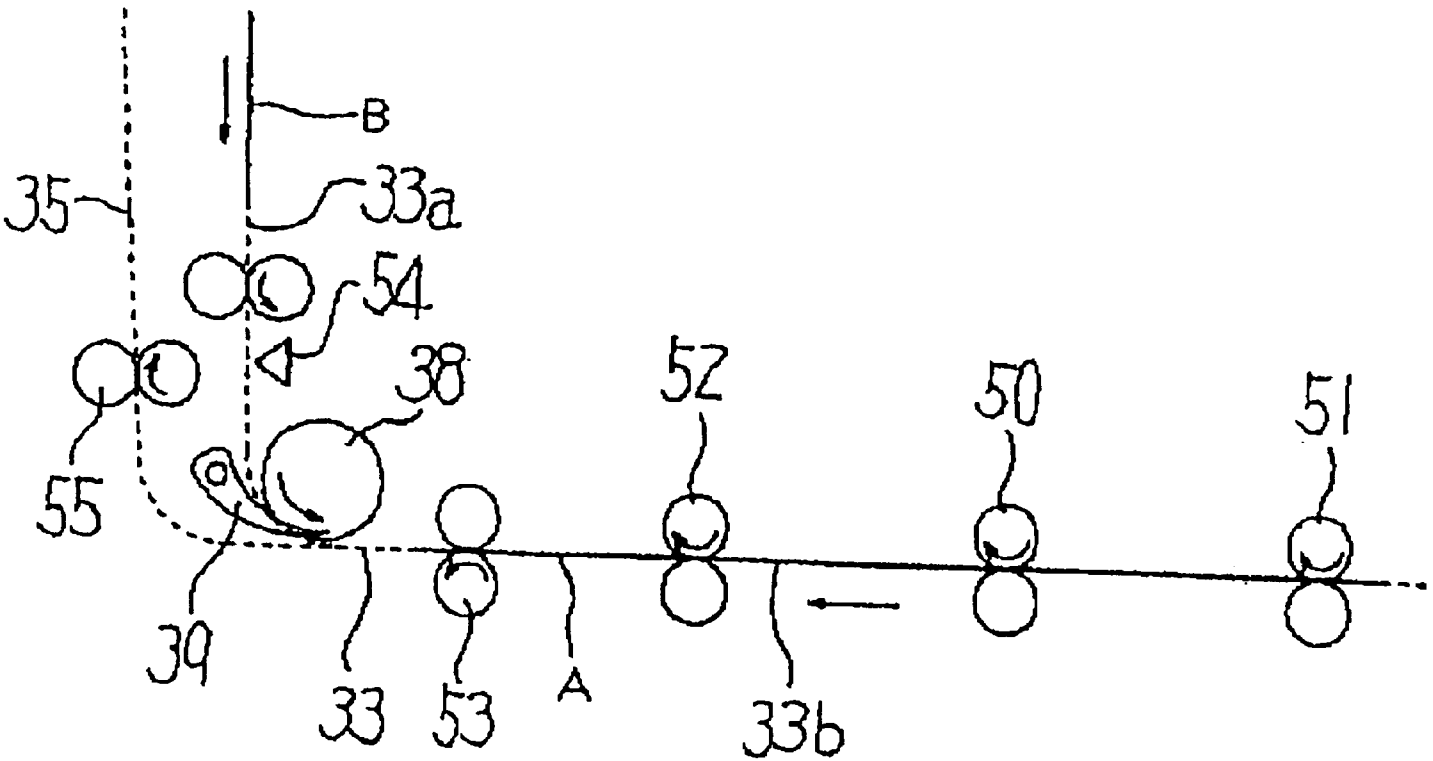
FIG. 13 is a view showing the feed of sheets in the reverse discharge mode unique to an alternative embodiment of the present invention.
Figure 14:
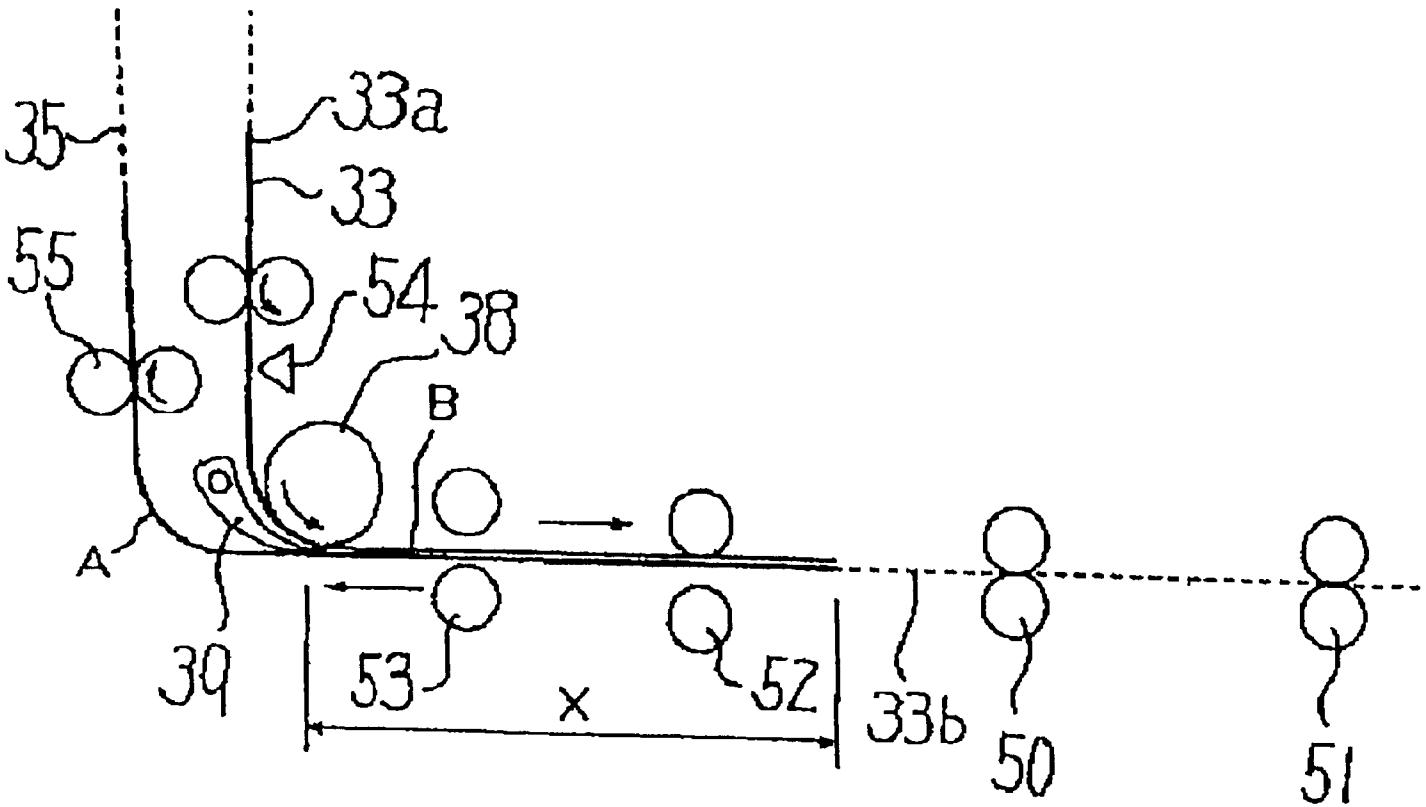
FIGS. 14 and 15 are views demonstrating sheet feed in the reverse discharge mode particular to the embodiment shown in FIG. 13.
Figure 15:
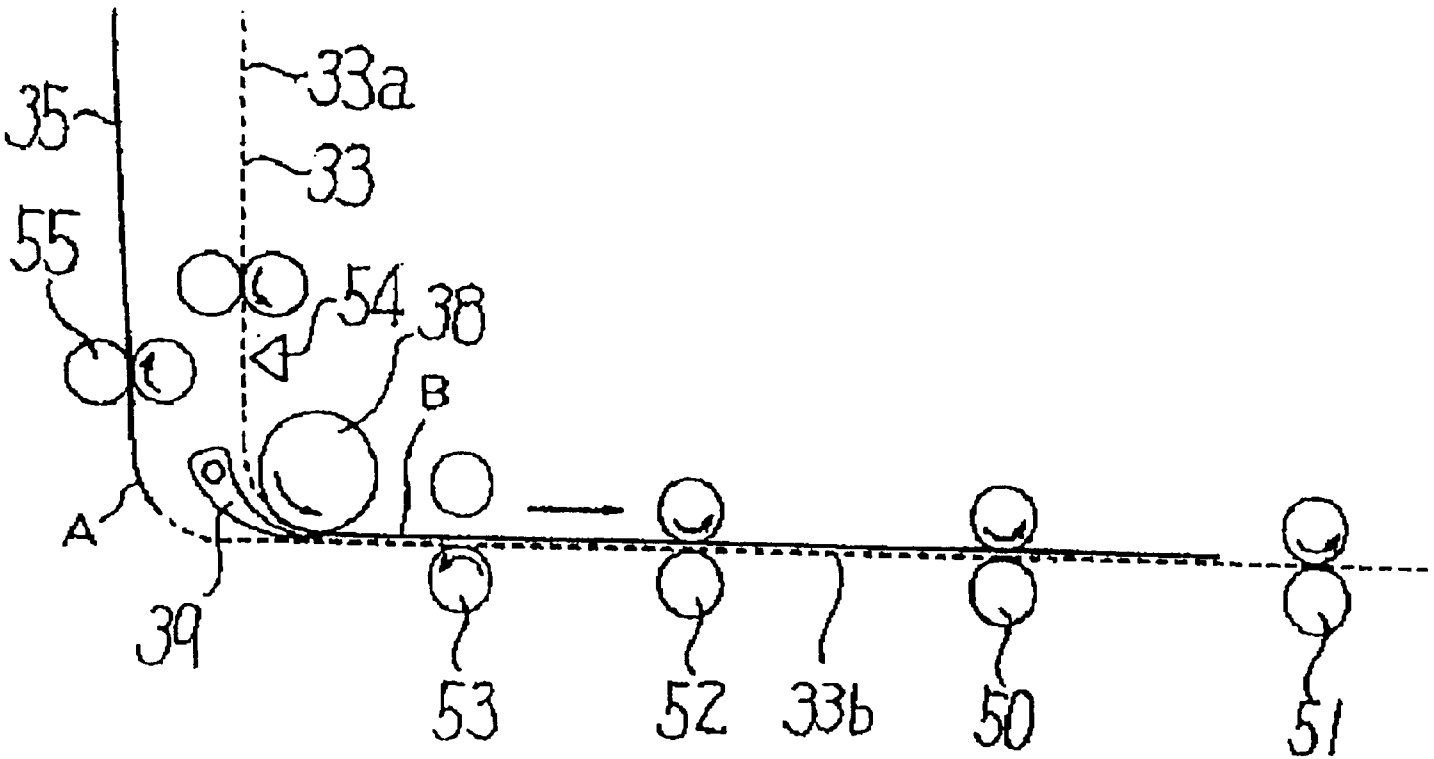

Referring to FIGS. 13 through 15, an alternative embodiment of the present invention will be described. In the alternative embodiment, as well as in the other alternative embodiments to be described later, structural elements identical with the structural elements of the previous embodiment are designated by identical reference numerals and will not be described specifically in order to avoid redundancy.

As shown in FIGS. 13 through 15, first reversible rollers 50 and 51, a second reversible roller 52 and a reverse roller 53 are arranged in the horizontal portion 33*b* of the refeed path 33. The first reversible rollers 50 and 51 constitute conveying means, reverse discharging means and refeed rollers at the same time. The second reversible roller 52 constitutes conveying means and reverse discharging means at the same time. The reverse roller 53 also plays the role of reverse discharging means. A trailing edge sensor 54 is positioned in the vertical portion 33*a* of the refeed path 33 in order to sense the trailing edge of a sheet. Further, the roller 38 and path selector 39 are positioned at the junction of the refeed path 33 and reverse discharging path 35.

The reversible rollers 50 and 51 each are implemented as a drive roller connected to a stepping motor, DC servo motor or similar reversible motor, not shown, and a driven roller constantly held in contact with the drive roller. The rollers 50 and 51 each are selectively rotatable in the forward direction for conveying a sheet from the horizontal portion 33*b* to the conveyance path 4 or in the reverse direction for switching it back to the reverse discharge path 35.

As shown in FIG. 14, the horizontal portion 33*b* includes a passing range X downstream of the junction of the refeed path 33 and reverse discharge path 35. A preceding sheet A entering reverse discharge path 35 and a following sheet B entering the horizontal portion 33*b* pass each other in the range X. The passing range X varies in accordance with the size and speed of the sheets A and B and varies every moment in accordance with the positions of the sheets A and B being conveyed. The passing range X shown in FIG. 14 is the maximum range.

The first reversible rollers 50 and 51 are located outside of the passing range X. This obviates an occurrence that the following sheet B reaches the rollers 50 and 51 when the rollers 50 and 51 are conveying the preceding sheet A toward the reverse discharge path 35. More specifically, when the following sheet B reaches the rollers 50 and 51, the preceding sheet A has already been released from the rollers 50 and 51. The rollers SO and 51 can therefore rotate in the forward direction to convey the following sheet B entered the horizontal portion 33*b* to a preselected position downstream of the rollers 50 and 51. The rollers 50 and 51 therefore do not have to be switched to the open position even when the two sheets A and B pass each other. That is, the rollers 50 and 51 should only be switched in the direction of rotation.

The second reversible roller 52 is identical in basic structure with the first reversible rollers 50 and 51. The difference is that a driven roller forming part of the roller 52 is movable away from a drive roller forming the other part of the roller 52. This is effected by a solenoid not shown. Further, the roller 52 lies or does not lie in the passing range, depending on the size of the sheet to be driven into the reverse discharge path 35. When the preceding sheet A and following sheet B are to pass each other at the position of the roller 52, the roller 52 is brought to its open position so as not to obstruct the pass.

The reverse roller 53 adjoins the junction of the horizontal portion 33*b* of the refeed path 33 and reverse discharge path 35. The reverse roller 53 also has a drive roller and a driven roller and so rotates as to drive a sheet toward the reverse discharge path 35. A solenoid, not shown, selectively brings the driven roller into or out of contact with the drive roller. When the reverse roller 53 rotates to drive the sheet toward the reverse discharge path 35, the roller 53 and the other rollers 50, 51 and 52 rotate at the same peripheral speed in synchronism with each other. This prevents the sheet being conveyed toward the reverse discharge path 35 from being pulled or slackened between the rollers 50, 51 and 52 and the roller 53.

The trailing edge sensor 54 adjoins the junction of the refeed path 33 and reverse discharge path 35 at a position upstream of the junction. The trailing edge sensor 54 senses the trailing edge of a sheet being conveyed along the refeed path 33. The direction of rotation of the rollers 50, 51 and 52 are switched from forward to reverse in accordance with the output of the sensor 54. Also, the rollers 53 and 52 are brought to the closed position in accordance with the output of the sensor 54.

A reverse discharge roller 55 is positioned on the reverse discharge path 35 and rotated to discharge a sheet along the path 35. The reverse discharge roller 55 is positioned such that before the leading edge of the following sheet B being conveyed along the refeed path 33 reaches the reverse roller 53, the leading edge of the preceding sheet A reaches the roller 55. In this condition, when the reverse roller 53 is switched to the closed position for allowing the two sheets A and B to pass each other, the roller 55 can nip the leading edge of the sheet A to thereby smoothly discharge the sheet A. Further, the roller 55 and rollers 50, 51 and 52 drive a sheet toward the reverse discharge path 35 at a speed higher than the speed at which a sheet is introduced into the refeed path 33. This is achievable by, e.g., assigning a particular motor speed to each of forward rotation and reverse rotation.

FIG. 13 shows a condition in which the preceding sheet A has started moving out of the horizontal portion 33*a* toward the reverse discharge path 35 while the following sheet B is being conveyed toward the horizontal portion 33*b* via the vertical portion 33*b*. At this instant, the rollers 50, 51 and 52, as well as the reverse roller 53, all are rotated in the reverse direction, conveying the sheet A toward the reverse discharge path 35.

FIG. 14 shows a condition in which the preceding sheet A and following sheet B are passing each other at the horizontal portion 33*b*. At this time, the roller 52 and reverse roller 53 lying in the passing range X are switched to the open position and therefore do not obstruct the following sheet B. The preceding sheet A has its leading edge nipped by the reverse discharge roller 55 and can therefore be smoothly conveyed toward the sheet outlet section 3 even when released from the rollers 50 through 53.

FIG. 15 shows a condition in which the entire preceding sheet A has entered the reverse discharge path 35 while the following sheet B is being conveyed along the horizontal portion 33*b* toward the path 4. The rollers 50 through 52 are rotated in the forward direction while the reverse roller 53 is held in the open position. When the trailing edge sensor 54 senses the trailing edge of the following sheet B arrived at the preselected position in the horizontal portion 33*b*, the condition shown in FIG. 13 is again set up. As a result, the rollers 50 through 52 and reverse roller 53 start switching back the sheet B toward the reverse discharge path 35. It follows that the sheet B does not become free during the switching of the direction at all and is therefore prevented from skewing or shifting in the widthwise direction.

If the sheet being switched back toward the reverse discharge path 3S is relatively long, then the roller 52 and reverse roller 53 are omissible; the rollers 50 and 51 can switch back the sheet alone.

Figure 16:
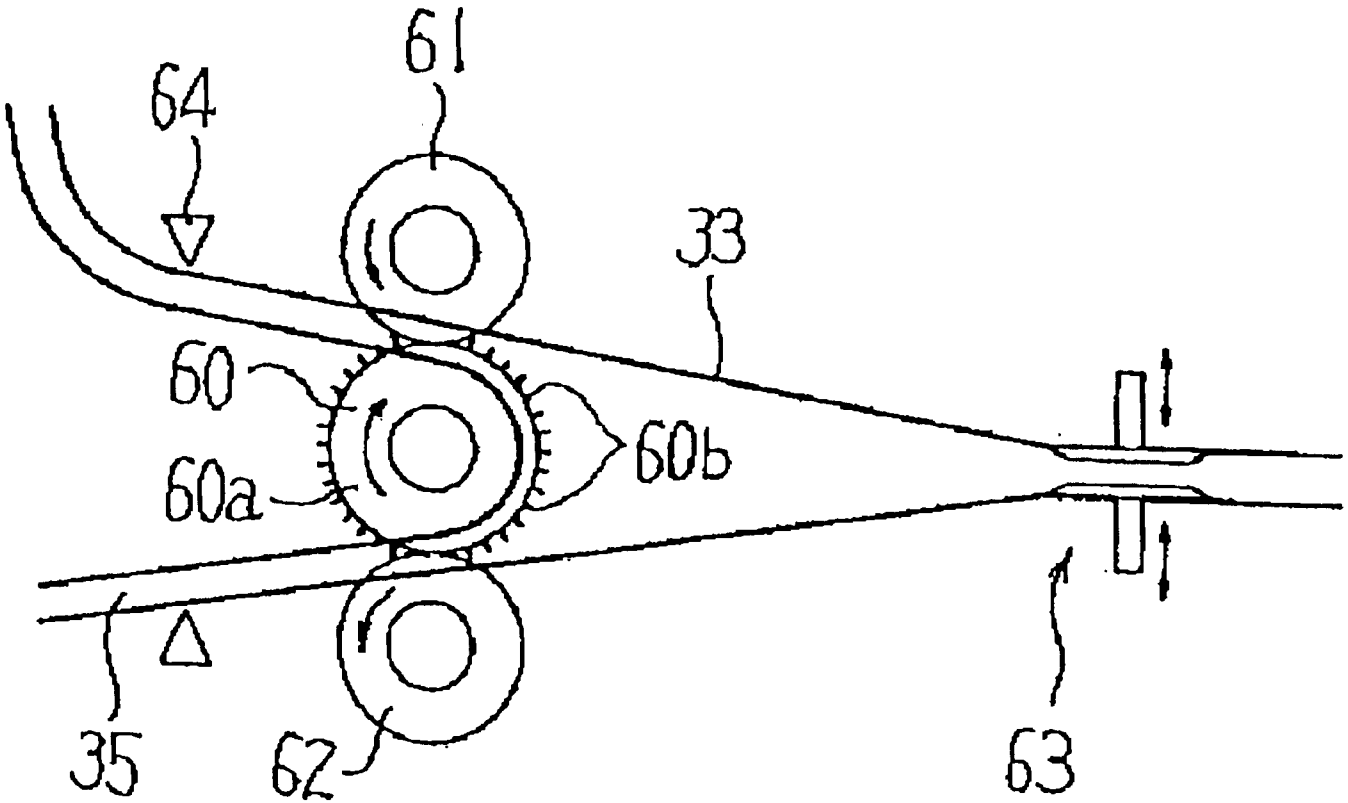
FIG. 16 is a view showing a switchback mechanism representative another alternative embodiment of the present invention.

FIG. 16 shows another alternative embodiment of the present invention. As shown, a roller 60, a first and a second roller 61 and 62 facing the roller 60, a pad or gripping means 63 and a sensor 64 are arranged around the junction of the refeed path 33 and reverse discharge path 35. The circumference of the roller 60 partly faces the refeed path 33 and reverse discharge path 35. A motor, not shown, rotates the roller 60 in the direction in which a sheet being conveyed along the refeed path 33 advances and the direction in which a sheet being conveyed along the reverse discharge path 35 advances. The roller 60 includes a cylindrical roller body 60*a* and a number of lugs 60*b* extending radially outward from the circumference of the roller body 60*a*. The lugs 60*b* are formed of an elastic material.

The first roller 61 contacts and is driven by the roller 60 to drive a sheet being conveyed along the refeed path 33. At the position where the first roller 61 contacts the roller 60, the lugs 60*b* of the roller 60 yield and become substantially flush with the circumference of the roller body 60*a*. The second roller 62 also contacts and is driven by the roller 60 to drive a sheet being conveyed along the revere discharge path 35. At the position where the first roller 62 contacts the roller 60, the lugs 60*b* of the roller 60 yield and become substantially flush with the circumference of the roller body 60*a*.

The sensor 64 is positioned upstream of the first roller 61 in the direction of sheet conveyance and senses the leading edge and trailing edge of a sheet. A solenoid or similar actuator, not shown, selectively moves the pad 63 to a gripping position for gripping and stopping a sheet on the refeed path 33 or a releasing position for releasing it.

In operation, a sheet conveyed along the refeed path 33 is conveyed by the roller 61 and first roller, which are rotating in directions indicated by arrows in FIG. 16. Just after the sensor 64 has sensed the trailing edge of the sheet, but before the trailing edge moves away from the roller 60 and first roller 61, the pad 63 is moved to the gripping position to grip the sheet for thereby stopping the movement of the sheet. Even after the pad 63 has gripped the sheet, the roller 60 is continuously rotated to convey the trailing edge of the sheet along the refeed path 33. As a result, the sheet bends between the pad 63 and the roller 60 little by little. When the trailing edge of the sheet moves away from the roller 60 and first roller 61, the lugs 60*b* of the roller 60 retain the trailing edge of the sheet and convey it toward the reverse discharge path 35 in accordance with the rotation of the roller 60. AS soon as the trailing edge of the sheet arrives at a preselected position adjoining the reverse discharge path 35, the bent sheet bounces upward due to its own restoring force. Consequently, the trailing edge of the sheet is released from the lugs 60*b* and enters the nip between the roller 60 and the second roller 62.

Just after the trailing edge of the sheet has entered the nip between the roller 60 and the second roller 62, the pad 63 is moved to the releasing position. As a result, the sheet is conveyed by the roller 60 and second roller 62 to the reverse discharge path 35.

As stated above, the illustrative embodiment does not locate a path selector or similar hard member around the junction of the refeed path 33 and reverse discharge path 35. This protects a sheet and therefore an image carried thereon from damage ascribable to friction otherwise acting between the sheet and such a path selector. Further, at the time of switchback, the lugs 60*b* convey the leading edge of a sheet (trailing edge before switchback) without causing it to shift in the oblique direction, thereby preventing the sheet from skewing.

Figure 17:
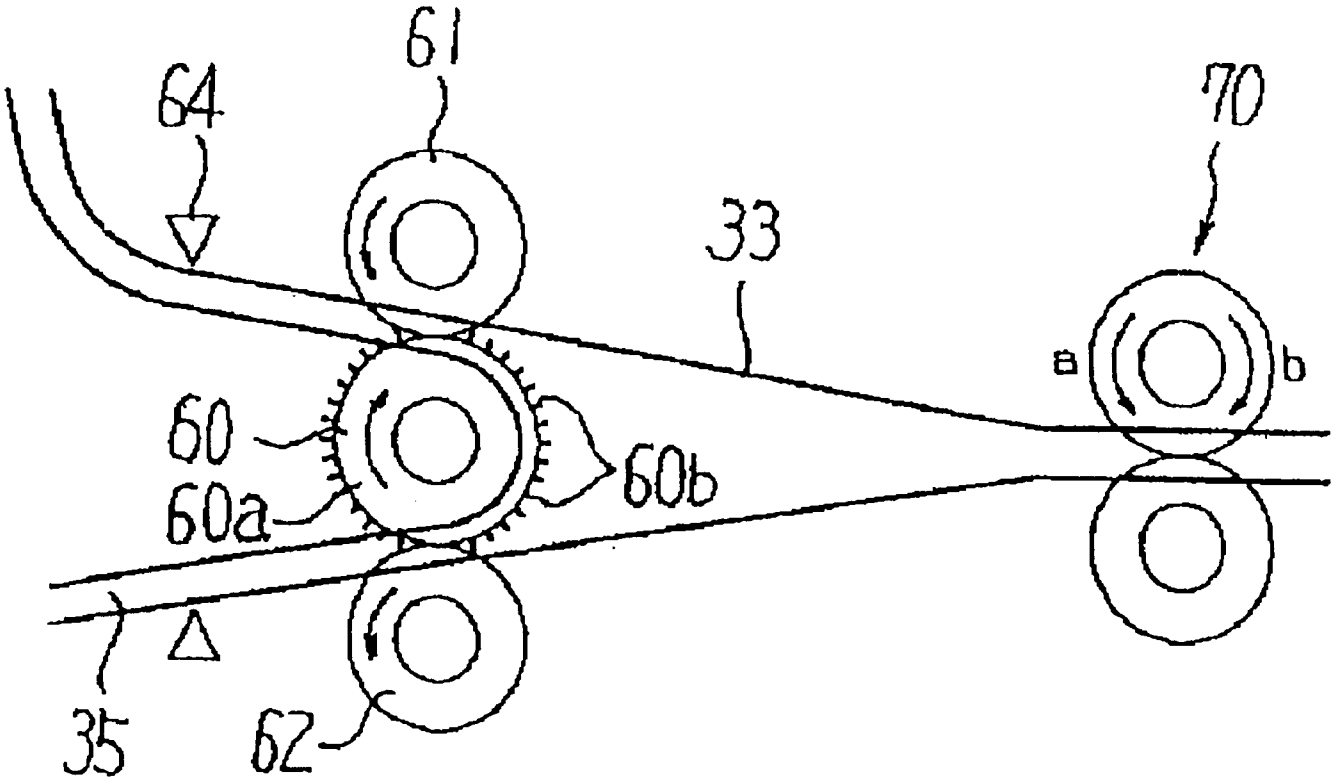
FIG. 17 is a view showing a switchback mechanism representative of a further alternative embodiment of the present invention.

FIG. 17 shows a further alternative embodiment of the present invention. As shown, this embodiment is identical with the embodiment described with reference to FIG. 16 except that a reversible roller 70 is substituted for the pad 63 as alternative gripping and stopping means. In the event of reverse discharge, the roller 70 is rotated in a direction a for conveying a sheet coming in through the refeed path 33. On the elapse of a preselected period of time since the sensor 64 has sensed the trailing edge of the sheet, e.g., when the trailing edge moves away from the roller 60 and first roller 61, the roller 70 is caused to rotate in a direction b for again conveying the sheet toward the roller 60. Consequently, the lugs 60*b* retain the leading edge of the sheet (trailing edge before switchback) and convey it toward the reverse discharge path 35. This is followed by the conveyance described with reference to FIG. 16.

The reversible roller 70 substituted for the pad 63, FIG. 16, makes it needless for a sheet to bend between the roller 60 and the roller 70 and therefore frees the sheet from curling.

If desired, at the time when the direction of rotation of the roller 70 is switched, the conveying speed of the roller 70 conveying a sheet on the refeed path 33 may be reduced below the conveying speed of the roller 60 and then stopped and switched in the direction of rotation. In this configuration, when the roller 70 stops rotating while gripping the sheet, the sheet can gently bend between the rollers 60 and 70. At the time of reverse discharge, the edge of the sheet is prevented from parting from the roller 60, so that a switchback time is reduced.

In summary, it will be seen that the present invention provides an image forming apparatus having various unprecedented advantages, as enumerated below.

(1) When a preceding sheet is switched back from a switchback path toward a conveyance path, the preceding sheet and the following sheet being introduced into the switchback path at least partly overlap each other. Therefore, by controlling the speed of the sheet being conveyed to the switchback path and the speed and timing of the sheet being driven out of the same path, it is possible to accurately maintain a short distance between sheets to be fed to an image forming section. This can be done without regard to irregularity in the timing of sheet feed from a sheet tray or in the speed of conveyance to the switchback path. Further, in a duplex print mode, the switchback path can be used as a path for switching back a one-sided sheet and again feeding it toward an image forming section. This makes an exclusive path for the duplex print mode needless. The apparatus is therefore reduced in thickness despite the presence of the switchback path (2) When the one-sided sheet is driven into a refeed path, reverse discharging means switches back the sheet and conveys it into the reverse discharge path. The sheet can therefore be driven out to a sheet outlet section face down in order of page.

(3) A refeed roller for switching the direction of sheet feed plays the role of conveying means and reverse discharging means at the same time, simplifying the structure of the apparatus. At the time of reverse discharge, the refeed roller rotating in the forward direction nips the sheet introduced into the refeed path and then rotates in the reverse direction to thereby drive the sheet toward the reverse discharge path. The sheet therefore does not become free during conveyance to the reverse discharge path and is therefore prevented from skewing.

(4) The sheet being switched back to the reverse discharge path and the following sheet coming in through the refeed path can pass each other. Therefore, the following sheet can enter the refeed path when the trailing edge of the preceding sheet entering the reverse discharge path is still positioned in the refeed path. The preceding sheet can therefore smoothly reversed and discharged even when the distance between sheets being conveyed along the refeed path is short.

(5) When the refeed roller is rotating in the reverse direction to nip and convey the preceding sheet to the reverse discharge path, the following sheet coming in through the refeed path is prevented from reaching the refeed roller. Therefore, even when the preceding sheet and following sheet pass each other, the refeed roller does not have to be opened, but should only be switched in the direction of rotation.

(6) A simple biasing member suffices to switch the position of a path selector that deals with a sheet to enter the refeed path or the reverse discharge path. This not only obviates the need for a solenoid or similar electronic actuator, but also realizes sure, high-speed switching.

(7) The sheet being switched back toward the reverse discharge path does not contact a path selector or similar member and is therefore free from damage ascribable to rubbing, preventing image quality from being degraded. Further, lugs retain the leading edge of the sheet and convey the leading edge to the reverse discharge path side without causing it to shift in the oblique direction. The sheet is therefore from skew when being conveyed along the reverse discharge path.

(8) A pad is movable to a gripping position in order to grip the sheet coming in through the refeed path and stop it. This is also true with a roller that can stop rotating.

(9) The sheet can be driven out of the refeed path to the conveyance path at an adequate timing, implementing interleaf sheet feed.

(10) In an Interleaf, duplex print mode, the sheet being conveyed along the refeed path can be rapidly brought to the junction of the refeed path and conveyance path. This successfully reduces the distance between the sheet being fed from the sheet tray and the sheet being driven out of the refeed path to the conveyance path, thereby enhancing the productivity of image formation.

(11) Punching, stapling or similar finishing is easy to execute with a stack of sheets because the distance between sheets sequentially discharged to the sheet outlet section can be increased.

Various modifications will become possible for those skilled in the art after receiving the teachings of the present disclosure without departing from the scope thereof.

What is claimed is:

1. An image forming apparatus comprising:

a sheet tray loaded with a stack of sheets;

separating and feeding means for feeding one sheet from said sheet tray while separating said one sheet from the other sheets;

an image forming section for forming an image on the sheet fed by said separating and feeding means;

a conveyance path for conveying the sheet from said sheet tray to said image forming section;

a switchback path connected to an intermediate portion of said conveyance path for receiving the sheet being conveyed along said conveyance path;

reversing means selectively switchable to a first position for switching back a preceding sheet introduced into said switchback path to thereby feed said sheet to said conveyance path or a second position for allowing said preceding sheet being fed from said switchback path and a sheet to be introduced into said switchback path after said preceding sheet to at least partly overlap each other;

a refeed path connected to a sheet outlet side of said image forming section and part of said conveyance path upstream of said switchback path; and conveying means for conveying the sheet driven into said refeed path to said conveyance path.

2. The apparatus as claimed in claim 1, wherein said image forming section comprises an eletrophotographic image forming section.

3. The apparatus as claimed in claim 1, wherein said image forming section comprises a digital electrophotographic image forming section including digital writing means.

4. The apparatus as claimed in claim 1, wherein said conveying means is capable of feeding the sheet driven into said refeed path to said conveyance path at a time interval.

5. The apparatus as claimed in claim 4, wherein the sheet is conveyed along said refeed path at a speed higher than an image forming process speed of said image forming section.

6. The apparatus as claimed in claim 5, further comprising a reverse discharge path extending from an intermediate portion of said refeed path to a sheet outlet section, wherein the sheet is conveyed along said reverse discharge path at a speed higher than the image forming process speed of said image forming section.

7. The apparatus as claimed in claim 6, wherein said image forming section comprises an eletrophotographic image forming section.

8. The apparatus as claimed in claim 6, wherein said image forming section comprises a digital electrophotographic image forming section including digital writing means.

9. The apparatus as claimed in claim 1 wherein the sheet is conveyed along said refeed path at a speed higher than an image forming process speed of said image forming section.

10. The apparatus as claimed in claim 9, further comprising a reverse discharge path extending from an intermediate portion of said refeed path to a sheet outlet section, wherein the sheet is conveyed along said reverse discharge path at a speed higher than the image forming process speed of said image forming section.

11. The apparatus as claimed in claim 10, wherein said image forming section comprises an eletrophotographic image forming section.

12. The apparatus as claimed in claim 10, wherein said image forming section comprises a digital electrophotographic image forming section including digital writing means.

13. The apparatus as claimed in claim 1, further comprising:

a reverse discharge path extending from an intermediate portion of said refeed path to a sheet outlet section; and reverse discharging means for switching back the sheet driven into said refeed path toward said reverse discharge path.

14. The apparatus as claimed in claim 13, wherein said conveying means and said reverse discharging means comprise a reversible refeed roller positioned downstream of a junction of said refeed path and said reverse discharge path and selectively rotatable in a forward direction for nipping and conveying the sheet driven into said refeed path toward said conveyance path or a reverse direction for switching back said sheet toward said reverse discharge path while nipping said sheet.

15. The apparatus as claimed in claim 14, wherein said refeed path allows a preceding sheet switched back and being fed to said reverse discharge path and a following sheet being conveyed along said refeed path to pass each other.

16. The apparatus as claimed in claim 15, wherein said refeed roller is positioned outside of a range wherein the preceding sheet and the following sheet pass each other.

17. The apparatus as claimed in claim 16, further comprising a path selector positioned at the junction of said refeed path and said reverse discharge path and a biasing member constantly biasing said path selector, wherein said biasing member biases said path selector to a position where the sheet switched back on said refeed path is capable of entering said reverse discharge path, and exerts a force so sized as to allow said path selector to move to another position where a sheet discharged from said image forming section and being conveyed along said refeed path is capable of advancing on contacting said path selector.

18. The apparatus as claimed in claim 17, further comprising:

a roller located at the junction of said refeed path and said reverse discharge path and rotatable in a direction in which the sheet moves along said refeed path and a direction in which said sheet moves along said reverse discharge path, said roller being formed with a plurality of lugs extending radially outward from a circumference of said roller;

a first roller contacting the circumference of said roller and rotatable for conveying the sheet being conveyed along said refeed path by nipping said sheet between said first roller and said roller;

a second roller contacting the circumference of said roller and rotatable for conveying the sheet being conveyed along said reverse discharge path by nipping said sheet between said first roller and said roller; and gripping means positioned on said refeed path downstream of said first roller for gripping the sheet being conveyed along said refeed path to thereby stop a movement of said sheet.

19. The apparatus as claimed in claim 18, wherein said gripping means comprises a pad selectively movable to a gripping position or a releasing position.

20. The apparatus as claimed in claim 18, wherein said gripping means comprises a reversible roller for nipping the sheet.

21. The apparatus as claimed in claim 18, wherein said conveying means is capable of feeding the sheet driven into said refeed path to said conveyance path at a desired timing.

22. The apparatus as claimed in claim 19, wherein the sheet is conveyed along said refeed path at a speed higher than an image forming process speed of said image forming section.

23. The apparatus as claimed in claim 22, further comprising a reverse discharge path extending from an intermediate portion of said refeed path to a sheet outlet section, wherein the sheet is conveyed along said reverse discharge path at a speed higher than the image forming process speed of said image forming section.

24. The apparatus as claimed in claim 23, wherein said image forming section comprises an eletrophotographic image forming section.

25. The apparatus as claimed in claim 23, wherein said image forming section comprises a digital electrophotographic image forming section including digital writing means.

26. The apparatus as claimed in claim 13, wherein said refeed path allows a preceding sheet switched back and being fed to said reverse discharge path and a following sheet being conveyed along said refeed path to pass each other.

27. The apparatus as claimed in claim 26, wherein said refeed roller is positioned outside of a range wherein the preceding sheet and the following sheet pass each other.

28. The apparatus as claimed in claim 27, further comprising a path selector positioned at the junction of said refeed path and said reverse discharge path and a biasing member constantly biasing said path selector, wherein said biasing member biases said path selector to a position where the sheet switched back on said refeed path is capable of entering said reverse discharge path, and exerts a force so sized as to allow said path selector to move to another position where a sheet discharged from said image forming section and being conveyed along said refeed path is capable of advancing on contacting said path selector.

29. The apparatus as claimed in claim 28, further comprising:

a roller located at the junction of said refeed path and said reverse discharge path and rotatable in a direction in which the sheet moves along said refeed path and a direction in which said sheet moves along said reverse discharge path, said roller being forced with a plurality of lugs extending radially outward from a circumference of said roller;

a first roller contacting the circumference of said roller and rotatable for conveying the sheet being conveyed along said refeed path by nipping said sheet between said first roller and said roller;

a second roller contacting the circumference of said roller and rotatable for conveying the sheet being conveyed along said reverse discharge path by nipping said sheet between said first roller and said roller; and gripping means positioned on said refeed path downstream of said first roller for gripping the sheet being conveyed along said refeed path to thereby stop a movement of said sheet.

30. The apparatus as claimed in claim 29, wherein said gripping means comprises a pad selectively movable to a gripping position or a releasing position.

31. The apparatus as claimed in claim 29, wherein said gripping means comprises a reversible roller for nipping the sheet.

32. The apparatus as claimed in claim 29, wherein said conveying means is capable of feeding the sheet driven into said refeed path to said conveyance path at a desired timing.

33. The apparatus as claimed in claim 30, wherein the sheet is conveyed along said refeed path at a speed higher than an image forming process speed of said image forming section.

34. The apparatus as claimed in claim 33, further comprising a reverse discharge path extending from an intermediate portion of said refeed path to a sheet outlet section, wherein the sheet is conveyed along said reverse discharge path at a speed higher than the image forming process speed of said image forming section.

35. The apparatus as claimed in claim 34, wherein said image forming section comprises an eletrophotographic image forming section.

36. The apparatus as claimed in claim 34, wherein said image forming section comprises a digital electrophotographic image forming section including digital writing means.

37. The apparatus as claimed in claim 13, further comprising a path selector positioned at the junction of said refeed path and said reverse discharge path and a biasing member constantly biasing said path selector, wherein said biasing member biases said path selector to a position where the sheet switched back on said refeed path is capable of entering said reverse discharge path, and exerts a force so sized as to allow said path selector to move to another position where a sheet discharged from said image forming section and being conveyed along said refeed path is capable of advancing on contacting said path selector.

38. The apparatus as claimed in claim 37, further comprising:

a roller located at the junction of said refeed path and said reverse discharge path and rotatable in a direction in which the sheet moves along said refeed path and a direction in which said sheet moves along said reverse discharge path, said roller being formed with a plurality of lugs extending radially outward from a circumference of said roller;

a first roller contacting the circumference of said roller and rotatable for conveying the sheet being conveyed along said refeed path by nipping said sheet between said first roller and said roller;

a second roller contacting the circumference of said roller and rotatable for conveying the sheet being conveyed along said reverse discharge path by nipping said sheet between said first roller and said roller; and gripping means positioned on said refeed path downstream of said first roller for gripping the sheet being conveyed along said refeed path to thereby stop a movement of said sheet.

39. The apparatus as claimed in claim 38, wherein said gripping means comprises a pad selectively movable to a gripping position or a releasing position.

40. The apparatus as claimed in claim 38, wherein said gripping means comprises a reversible roller for nipping the sheet.

41. The apparatus as claimed in claim 38, wherein said conveying means is capable of feeding the sheet driven into said refeed path to said conveyance path at a desired timing.

42. The apparatus as claimed in claim 39, wherein the sheet is conveyed along said refeed path at a speed higher than an image forming process speed of said image forming section.

43. The apparatus as claimed in claim 42, further comprising a reverse discharge path extending from an intermediate portion of said refeed path to a sheet outlet section, wherein the sheet is conveyed along said reverse discharge path at a speed higher than the image forming process speed of said image forming section.

44. The apparatus as claimed in claim 43, wherein said image forming section comprises an eletrophotographic image forming section.

45. The apparatus as claimed in claim 43, wherein said image forming section comprises a digital electrophotographic image forming section including digital writing means.

46. The apparatus as claimed in claim 45, further comprising:

a roller located at the junction of said refeed path and said reverse discharge path and rotatable in a direction in which the sheet moves along said refeed path and a direction in which said sheet moves along said reverse discharge path, said roller being formed with a plurality of lugs extending radially outward from a circumference of said roller;

a first roller contacting the circumference of said roller and rotatable for conveying the sheet being conveyed along said refeed path by nipping said sheet between said first roller and said roller;

a second roller contacting the circumference of said roller and rotatable for conveying the sheet being conveyed along said reverse discharge path by nipping said sheet between said first roller and said roller; and gripping means positioned on said refeed path downstream of said first roller for gripping the sheet being conveyed along said refeed path to thereby stop a movement of said sheet.

47. The apparatus as claimed in claim 46, wherein said gripping means comprises a pad selectively movable to a gripping position or a releasing position.

48. The apparatus as claimed in claim 46, wherein said gripping means comprises a reversible roller for nipping the sheet.

49. The apparatus as claimed in claim 46, wherein said conveying means is capable of feeding the sheet driven into said refeed path to said conveyance path at a desired timing.

50. The apparatus as claimed in claim 49, wherein the sheet is conveyed along said refeed path at a speed higher than an image forming process speed of said image forming section.

51. The apparatus as claimed in claim 50, further comprising a reverse discharge path extending from an intermediate portion of said refeed path to a sheet outlet section, wherein the sheet is conveyed along said reverse discharge path at a speed higher than the image forming process speed of said image forming section.

52. The apparatus as claimed in claim 51, wherein said image forming section comprises an eletrophotographic image forming section.

53. The apparatus as claimed in claim 51, wherein said image forming section comprises a digital electrophotographic image forming section including digital writing means.

54. The apparatus as claimed in claim 13, further comprising a reverse discharge path extending from an intermediate portion of said refeed path to a sheet outlet section, wherein the sheet is conveyed along said reverse discharge path at a speed higher than the image forming process speed of said image forming section.

55. The apparatus as claimed in claim 54, wherein said image forming section comprises an eletrophotographic image forming section.

56. The apparatus as claimed in claim 54, wherein said image forming section comprises a digital electrophotographic image forming section including digital writing means.

* * * * *